US011783667B2

(12) United States Patent
Taylor et al.

(10) Patent No.: US 11,783,667 B2
(45) **Date of Patent: *Oct. 10, 2023**

(54) SYSTEMS AND METHODS FOR SECURELY CONNECTING AN ELECTRONIC GAMING MACHINE TO AN END USER DEVICE

(71) Applicant: Aristocrat Technologies, Inc., Las Vegas, NV (US)

(72) Inventors: Eric Taylor, Carson City, NV (US); Steven Santisi, Las Vegas, NV (US); Angelo Palmisano, Henderson, NV (US); John Dawson, III, Spring Hill, TN (US); Damian Tarnawsky, Las Vegas, NV (US); Rajendrasinh Jadeja, Las Vegas, NV (US); Bruce Urban, Las Vegas, NV (US); Joseph Kaminkow, Las Vegas, NV (US); Craig Paulsen, Reno, NV (US)

(73) Assignee: Aristocrat Technologies, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/674,672

(22) Filed: Feb. 17, 2022

(65) Prior Publication Data

US 2022/0180700 A1 Jun. 9, 2022

Related U.S. Application Data

(63) Continuation of application No. 17/220,778, filed on Apr. 1, 2021, now Pat. No. 11,276,271.
(Continued)

(51) Int. Cl.
*G07F 17/32* (2006.01)

(52) U.S. Cl.
CPC ..... *G07F 17/3225* (2013.01)

(58) Field of Classification Search
USPC ..... 463/42
See application file for complete search history.

(56) References Cited

U.S. PATENT DOCUMENTS

D305,704 S 1/1990 Jones
4,986,330 A 1/1991 McGonagle
(Continued)

FOREIGN PATENT DOCUMENTS

EP 0979604 A1 2/2000
EP 3280643 B1 4/2020
(Continued)

OTHER PUBLICATIONS

Office Action dated Sep. 25, 2020 for U.S. Appl. No. 16/264,875 (pp. 1-12).
(Continued)

*Primary Examiner* — Pierre E Elisca
(74) *Attorney, Agent, or Firm* — Armstrong Teasdale LLP

(57) ABSTRACT

An electronic gaming system including a casino management server and an electronic casino device is described. The electronic casino device includes a beacon configured to wirelessly communicate with end user devices (EUDs) of players and a processor. The processor executes instructions which cause the processor to transmit a request for a custom beacon ID, receive the custom beacon ID, and cause the beacon to wirelessly transmit the custom beacon ID to the EUD. The casino management server is configured to receive a connection request and validate that the received beacon ID matches the custom beacon ID. The casino management server is further configured to receive instructions from the EUD such that the player plays a game operated on the electronic casino device by physically
(Continued)

interacting with the EUD, wherein the instructions received from the EUD include a low-bandwidth instruction including no more than two bytes.

20 Claims, 16 Drawing Sheets

Related U.S. Application Data

(60) Provisional application No. 63/024,860, filed on May 14, 2020, provisional application No. 63/005,008, filed on Apr. 3, 2020.

(56) References Cited

U.S. PATENT DOCUMENTS

| | | | |
|---|---|---|---|
| D427,783 | S | 7/2000 | Luedke |
| 6,230,658 | B1 | 5/2001 | Rudolph |
| 6,394,907 | B1 | 5/2002 | Rowe |
| 6,510,572 | B2 | 1/2003 | Horowitz |
| 6,585,598 | B2 | 7/2003 | Nguyen |
| 6,739,975 | B2 | 5/2004 | Nguyen |
| 6,835,134 | B2 | 12/2004 | Poole |
| 6,846,238 | B2 | 1/2005 | Wells |
| 6,866,586 | B2 | 3/2005 | Oberberger et al. |
| 6,925,307 | B1 | 8/2005 | Mamdani |
| 7,114,718 | B2 | 10/2006 | Grauzer |
| 7,169,053 | B2 | 1/2007 | Moik |
| 7,240,036 | B1 | 7/2007 | Mamdani |
| 7,285,046 | B2 | 10/2007 | Papulov |
| 7,370,012 | B2 | 5/2008 | Karns |
| 7,390,263 | B1 | 6/2008 | Acres |
| 7,419,428 | B2 | 9/2008 | Rowe |
| 7,559,462 | B2 | 7/2009 | Brosnan |
| 7,749,079 | B2 | 7/2010 | Chamberlain |
| 7,771,277 | B2 | 8/2010 | Chamberlain |
| 7,819,742 | B2 | 10/2010 | Chamberlain |
| 7,918,728 | B2 | 4/2011 | Nguyen |
| D641,560 | S | 7/2011 | Thompson |
| 7,997,978 | B2 | 8/2011 | Kaminkow |
| 8,057,303 | B2 | 11/2011 | Rasmussen |
| D660,022 | S | 5/2012 | Thompson |
| 8,226,255 | B2 | 7/2012 | Fan |
| 8,333,653 | B2 | 12/2012 | Nyman |
| 8,382,582 | B2 | 2/2013 | Sammon |
| 8,393,955 | B2 | 3/2013 | Arezina |
| 8,449,378 | B2 | 5/2013 | Michaelson |
| 8,463,711 | B2 | 6/2013 | Cunningham, II |
| 8,469,800 | B2 | 6/2013 | Lemay |
| 8,523,657 | B2 | 9/2013 | Michaelson |
| 8,602,874 | B2 | 12/2013 | Rowe |
| 8,613,659 | B2 | 12/2013 | Nelson |
| D702,068 | S | 4/2014 | Mitten |
| 8,714,655 | B2 | 5/2014 | Cahall |
| 8,870,647 | B2 | 10/2014 | Huizinga |
| 8,875,639 | B2 | 11/2014 | Summerville |
| 8,956,222 | B2 | 2/2015 | Lemay |
| 8,961,298 | B2 | 2/2015 | Czyzewski |
| 8,992,306 | B2 | 3/2015 | Iddings |
| D726,424 | S | 4/2015 | Nguyen |
| 9,058,716 | B2 | 6/2015 | Rajaraman |
| 9,153,095 | B2 | 10/2015 | Adiraju |
| 9,159,189 | B2 | 10/2015 | Froy, Jr. |
| 9,167,383 | B1 | 10/2015 | Barrand |
| 9,226,578 | B2 | 1/2016 | Battey |
| 9,235,953 | B2 | 1/2016 | Earley |
| 9,245,414 | B2 | 1/2016 | Radisich |
| 9,269,231 | B2 | 2/2016 | Curtin |
| 9,311,769 | B2 | 4/2016 | Lemay |
| 9,317,995 | B2 | 4/2016 | Nyman |
| 9,324,209 | B2 | 4/2016 | Cunningham, II |
| 9,367,835 | B2 | 6/2016 | Nelson |
| 9,418,519 | B2 | 8/2016 | Walker |
| 9,437,073 | B2 | 9/2016 | Lestrange |
| 9,454,872 | B2 | 9/2016 | Muir |
| 9,483,901 | B2 | 11/2016 | Nguyen |
| 9,501,899 | B2 | 11/2016 | Radisich |
| D774,339 | S | 12/2016 | Parshad |
| 9,530,277 | B2 | 12/2016 | Nelson |
| D777,459 | S | 1/2017 | Parshad |
| 9,576,425 | B2 | 2/2017 | Nguyen |
| 9,580,031 | B2 | 2/2017 | Kalis |
| 9,613,491 | B2 | 4/2017 | Roth |
| 9,615,347 | B1 | 4/2017 | Kerr |
| 9,629,064 | B2 | 4/2017 | Graves |
| 9,659,444 | B2 | 5/2017 | Norris |
| 9,666,027 | B2 | 5/2017 | Curtin |
| D796,216 | S | 9/2017 | Rockwell |
| 9,756,607 | B1 | 9/2017 | Deluca |
| 9,786,123 | B2 | 10/2017 | Huizinga |
| 9,852,578 | B2 | 12/2017 | Nelson |
| D807,652 | S | 1/2018 | Kawamoto |
| 9,875,499 | B2 | 1/2018 | Washington |
| 9,875,607 | B2 | 1/2018 | Nelson |
| 9,881,444 | B2 | 1/2018 | Nelson |
| 9,928,502 | B2 | 3/2018 | Curtin |
| 9,928,689 | B2 | 3/2018 | Walker |
| 9,941,753 | B2 | 4/2018 | Asanuma |
| 9,961,507 | B1 | 5/2018 | Mendelson |
| 9,974,873 | B2 | 5/2018 | Cole |
| 9,999,699 | B2 | 6/2018 | Sinai |
| 10,009,868 | B1 | 6/2018 | Reyes |
| 10,013,850 | B2 | 7/2018 | Nelson |
| 10,032,334 | B2 | 7/2018 | Cuddy |
| 10,097,018 | B2 | 10/2018 | Park |
| 10,121,129 | B2 | 11/2018 | Kalgi |
| 10,121,318 | B2 | 11/2018 | Lemay |
| 10,121,319 | B2 | 11/2018 | Radisich |
| 10,131,432 | B2 | 11/2018 | Simeon |
| 10,134,223 | B2 | 11/2018 | Mandava |
| 10,134,234 | B2 | 11/2018 | Lestrange |
| 10,140,810 | B1 | 11/2018 | Boyle |
| 10,157,518 | B2 | 12/2018 | Johnson |
| 10,158,243 | B2 | 12/2018 | Kim |
| 10,192,400 | B2 | 1/2019 | Price |
| 10,192,401 | B2 | 1/2019 | Nelson |
| 10,198,906 | B2 | 2/2019 | Walker |
| 10,217,317 | B2 | 2/2019 | Nelson |
| 10,242,525 | B1 | 3/2019 | Knust |
| 10,242,530 | B2 | 3/2019 | Arnone |
| D848,159 | S | 5/2019 | Hiyoshi |
| D848,160 | S | 5/2019 | Hiyoshi |
| 10,282,939 | B2 | 5/2019 | Yamaguchi |
| 10,297,105 | B2 | 5/2019 | Lemay |
| 10,339,755 | B2 | 7/2019 | Snow |
| 10,360,761 | B2 | 7/2019 | Higgins |
| 10,360,763 | B2 | 7/2019 | Higgins |
| 10,373,430 | B2 | 8/2019 | Higgins |
| 10,380,843 | B2 | 8/2019 | Higgins |
| 10,417,867 | B2 | 9/2019 | Nelson |
| 10,453,297 | B2 | 10/2019 | Lemay |
| 10,460,560 | B2 | 10/2019 | Cunningham, II |
| 10,460,563 | B2 | 10/2019 | Miri |
| D870,473 | S | 12/2019 | Hamilton |
| 10,529,179 | B2 | 1/2020 | Weiss |
| 10,546,463 | B2 | 1/2020 | Higgins |
| D874,164 | S | 2/2020 | Hamilton |
| 10,573,129 | B2 | 2/2020 | Higgins |
| 10,621,826 | B2 | 4/2020 | Higgins |
| 10,643,426 | B2 | 5/2020 | Higgins |
| 10,699,527 | B2 | 6/2020 | Higgins |
| 10,706,683 | B2 | 7/2020 | Higgins |
| 10,720,016 | B2 | 7/2020 | Nelson |
| 10,726,668 | B2 | 7/2020 | Nelson |
| 10,755,520 | B2 | 8/2020 | Moore |
| 10,769,885 | B2 | 9/2020 | Hoehne |
| 10,783,416 | B2 | 9/2020 | Shigeta |
| 11,011,020 | B2 | 5/2021 | Springer |
| 11,024,088 | B2 * | 6/2021 | Heinen ..... G06T 7/593 |
| 11,087,587 | B2 | 8/2021 | Palmisano |
| 11,094,161 | B2 * | 8/2021 | Cleveland ..... G07F 17/3223 |
| 11,132,862 | B2 * | 9/2021 | Cleveland ..... A63F 1/06 |
| 11,227,466 | B2 | 1/2022 | Rousseau |
| D944,015 | S | 2/2022 | Greenwood |

(56) References Cited

U.S. PATENT DOCUMENTS

| | | | |
|---|---|---|---|
| 11,238,699 | B2 | 2/2022 | Wingate |
| 11,276,271 | B2 | 3/2022 | Taylor |
| 2002/0131445 | A1 | 9/2002 | Skubic |
| 2005/0194827 | A1 | 9/2005 | Dowty |
| 2006/0199648 | A1 | 9/2006 | Mitchell |
| 2007/0090335 | A1 | 4/2007 | Legrand |
| 2007/0117604 | A1 | 5/2007 | Hill |
| 2008/0045342 | A1 | 2/2008 | Crowder |
| 2008/0134601 | A1 | 6/2008 | Cruz |
| 2008/0178774 | A1 | 7/2008 | Saccani |
| 2008/0305855 | A1 | 12/2008 | Czyzewski |
| 2009/0191933 | A1 | 7/2009 | French |
| 2009/0252646 | A1 | 10/2009 | Holden |
| 2010/0004051 | A1 | 1/2010 | Walker |
| 2010/0312625 | A1 | 12/2010 | Miller |
| 2011/0227391 | A1 | 9/2011 | Cahall |
| 2011/0306400 | A1 | 12/2011 | Nguyen |
| 2012/0190455 | A1 | 7/2012 | Briggs |
| 2012/0252564 | A1 | 10/2012 | Moore |
| 2013/0023339 | A1 | 1/2013 | Davis |
| 2013/0084991 | A1 | 4/2013 | Lemay |
| 2013/0165232 | A1 | 6/2013 | Nelson |
| 2013/0252713 | A1 | 9/2013 | Nelson |
| 2013/0303263 | A1 | 11/2013 | Lemay |
| 2014/0015478 | A1 | 1/2014 | Von Novak |
| 2014/0021798 | A1 | 1/2014 | Kesler |
| 2014/0031107 | A1 | 1/2014 | Walker |
| 2014/0203770 | A1 | 7/2014 | Salter |
| 2014/0228109 | A1 | 8/2014 | Azuma |
| 2015/0044098 | A1 | 2/2015 | Smart |
| 2015/0086968 | A1 | 3/2015 | Kolavo |
| 2015/0228153 | A1 | 8/2015 | Hedrick |
| 2015/0243133 | A1 | 8/2015 | Nicholas |
| 2015/0254924 | A1 | 9/2015 | Pececnik |
| 2016/0000951 | A1 | 1/2016 | Kreiner |
| 2016/0027244 | A1 | 1/2016 | Adiraju |
| 2016/0027249 | A1 | 1/2016 | Nelson |
| 2016/0029155 | A1 | 1/2016 | Kerr |
| 2016/0073218 | A1 | 3/2016 | Shui |
| 2016/0092954 | A1 | 3/2016 | Bassett |
| 2016/0098891 | A1 | 4/2016 | Eby |
| 2016/0125319 | A1 | 5/2016 | Morgan |
| 2016/0133089 | A1 | 5/2016 | Roemer |
| 2016/0180656 | A1 | 6/2016 | Loose |
| 2016/0218545 | A1 | 7/2016 | Schroeder |
| 2016/0234123 | A1 | 8/2016 | Alisawi |
| 2016/0247354 | A1 | 8/2016 | Arnone |
| 2016/0283989 | A1 | 9/2016 | Esquilla, Jr. |
| 2016/0333578 | A1 | 11/2016 | Ng |
| 2016/0349929 | A1 | 12/2016 | Clemons |
| 2017/0076540 | A1 | 3/2017 | Saffari |
| 2017/0076546 | A1 | 3/2017 | Walker |
| 2017/0084086 | A1* | 3/2017 | Pio ..... G06T 7/60 |
| 2017/0092054 | A1 | 3/2017 | Petersen |
| 2017/0092060 | A1 | 3/2017 | Toohey |
| 2017/0092061 | A1 | 3/2017 | Nelson |
| 2017/0109770 | A1 | 4/2017 | Kusens |
| 2017/0111770 | A1 | 4/2017 | Kusens |
| 2017/0169657 | A1 | 6/2017 | Keilwert |
| 2017/0213632 | A1 | 7/2017 | Ozana |
| 2017/0278347 | A1 | 9/2017 | Kukita |
| 2017/0279495 | A1 | 9/2017 | Kim |
| 2017/0289154 | A1 | 10/2017 | Krieger |
| 2017/0346919 | A1 | 11/2017 | He |
| 2018/0005484 | A1 | 1/2018 | Michel |
| 2018/0033244 | A1* | 2/2018 | Northrup ..... G08G 1/0175 |
| 2018/0061179 | A1 | 3/2018 | Miri |
| 2018/0075690 | A1 | 3/2018 | Moore |
| 2018/0108213 | A1 | 4/2018 | Sanford |
| 2018/0194471 | A1 | 7/2018 | Merrick |
| 2018/0357850 | A1 | 12/2018 | Moore |
| 2019/0066441 | A1 | 2/2019 | Lestrange |
| 2019/0073873 | A1 | 3/2019 | Lemay |
| 2019/0088086 | A1 | 3/2019 | Rajendran |
| 2019/0096175 | A1 | 3/2019 | Higgins |
| 2019/0096180 | A1 | 3/2019 | Petersen |
| 2019/0102985 | A1 | 4/2019 | Higgins |
| 2019/0139356 | A1 | 5/2019 | Moya Garcia |
| 2019/0151752 | A1 | 5/2019 | Kim |
| 2019/0172300 | A1 | 6/2019 | Phillips |
| 2019/0188951 | A1 | 6/2019 | Nelson |
| 2019/0188961 | A1 | 6/2019 | Higgins |
| 2019/0188962 | A1 | 6/2019 | Higgins |
| 2019/0188963 | A1 | 6/2019 | Higgins |
| 2019/0197526 | A1 | 6/2019 | Higgins |
| 2019/0197822 | A1 | 6/2019 | Shepherd |
| 2019/0197830 | A1 | 6/2019 | Petersen |
| 2019/0205866 | A1 | 7/2019 | Higgins |
| 2019/0244476 | A1 | 8/2019 | Miltenberger |
| 2019/0272704 | A1 | 9/2019 | Lemay |
| 2019/0325701 | A1 | 10/2019 | Higgins |
| 2020/0005595 | A1 | 1/2020 | Nelson |
| 2020/0043284 | A1 | 2/2020 | Lemay |
| 2020/0058190 | A1 | 2/2020 | Cunningham, II |
| 2020/0111319 | A1 | 4/2020 | Palmisano |
| 2020/0134973 | A1 | 4/2020 | Higgins |
| 2020/0152005 | A1 | 5/2020 | Higgins |
| 2020/0226881 | A1 | 7/2020 | Warner |
| 2020/0302740 | A1 | 9/2020 | Cleveland |
| 2020/0302746 | A1* | 9/2020 | Cleveland ..... G06Q 20/3672 |
| 2021/0019987 | A1 | 1/2021 | Cohen |
| 2021/0241575 | A1 | 8/2021 | Shepherd |
| 2021/0295636 | A1 | 9/2021 | Cleveland |
| 2021/0386201 | A1 | 12/2021 | Wilson |
| 2022/0019950 | A1 | 1/2022 | Sabri |
| 2022/0092908 | A1 | 3/2022 | Cleveland |
| 2022/0148380 | A1 | 5/2022 | Wingate |

FOREIGN PATENT DOCUMENTS

| | | | |
|---|---|---|---|
| GB | 2273088 | A | 6/1994 |
| GB | 4010756 | | 4/2009 |
| KR | 20090059283 | A | 6/2009 |
| WO | 1999059451 | A1 | 11/1999 |
| WO | 2017196732 | A1 | 11/2017 |

OTHER PUBLICATIONS

AU Examination Report for AU Application No. 2018204598, dated Mar. 20, 2019. 5 pages.

Office Action dated Apr. 29, 2020 for U.S. Appl. No. 16/264,875 (pp. 1-8).

Notice of Allowance dated Jan. 7, 2021 for U.S. Appl. No. 16/264,875 (pp. 1-7).

Office Action dated Nov. 2, 2020 for U.S. Appl. No. 16/586,168 (pp. 1-7).

Notice of Allowance dated Dec. 2, 2020 for U.S. Appl. No. 16/586,246 (pp. 1-10).

Office Action dated Dec. 2, 2020 for U.S. Appl. No. 16/586,356 (pp. 1-7).

Notice of Allowance dated Feb. 11, 2021 for U.S. Appl. No. 16/586,127 (pp. 1-15).

Notice of Allowance dated Feb. 12, 2021 for U.S. Appl. No. 16/586,168 (pp. 1-5).

International Search Report and Written Opinion for App. No. PCT/US 19/53823, dated Jan. 3, 2020, 10 pages.

Corrected Notice of Allowability dated Apr. 14, 2021 for U.S. Appl. No. 16/586,127 (pp. 1-2).

Notice of Allowance dated Apr. 13, 2021 for U.S. Appl. No. 16/586,356 (pp. 1-5).

Australian Examination Report No. 1 for App. No. AU2020204407, dated Mar. 23, 2021, 4 pages.

Notice of Allowance dated Apr. 29, 2021 for U.S. Appl. No. 16/586,168 (pp. 1-5).

Eddystone format, https://developers.google.com/beacons/eddystone, printed Feb. 3, 2021, 9 pages.

Notice of Allowance dated May 26, 2021 for U.S. Appl. No. 16/586,246 (pp. 1-5).

Office Action (Notice of Allowance and Fees Due (PTOL-85)) dated Sep. 9, 2021 for U.S. Appl. No. 16/947,987 (pp. 1-8).

(56) References Cited

OTHER PUBLICATIONS

Office Action (Non-Final Rejection) dated Nov. 10, 2021 for U.S. Appl. No. 16/585,838 (pp. 1-13).
Office Action (Notice of Allowance and Fees Due (PTOL-85)) dated Nov. 22, 2021 for U.S. Appl. No. 17/220,778 (pp. 1-8).
Office Action (Non-Final Rejection) dated Mar. 8, 2022 for U.S. Appl. No. 17/262,178 (pp. 1-9).
Office Action (Notice of Allowance and Fees Due (PTOL-85)) dated Mar. 4, 2022 for U.S. Appl. No. 16/585,838 (pp. 1-7).
Office Action (Notice of Allowance and Fees Due (PTOL-85)) dated May 18, 2022 for U.S. Appl. No. 17/262,178 (pp. 1-7).
Notice of Allowance dated Jun. 24, 2022 for U.S. Appl. No. 29/734,939 (pp. 1-10).
"Shields for Casino Slots" Apr. 28, 2020, ReviewJournal, visited Jun. 7, 2022: https://www.reviewjournal.com/business/(casinos-gaming/las-vegas-firm-creates-safety-shields-for-use-at-casino-slots-tables-2016807/ (Year:2020).
"SuzoHapp" Jan. 14, 2020, GGRASIA, site visited Jun. 7, 2022: https://www.ggrasia.com/ suzohapp-offers-acrylic-dividers-for-gaming-venues/ (Year:2020).
"Protective Separators" Oct. 22, 2020, Needs Info Including URL Starting With veb.archive.org/ (Year: 2020).
Stabile, Angelica, "Las Vegas startup creates coronavirus self-cleaning slot machine dividers" May 5, 2020, Fox Business, site visited Jun. 9, 2022: https://www.foxbusiness.com/technology/las-vegas-company-coronavirus-slot-machine-dividers (Year:2020).
Office Action (Notice of Allowance and Fees Due (PTOL-85)) dated Aug. 16, 2022 for U.S. Appl. No. 17/211,521 (pp. 1-8).
Australian Examination Report No. 1 issued in App. No. AU2021202860, dated Jul. 19, 2022, 3 pages.
Office Action (Notice of Allowance and Fees Due (PTOL-85)) dated Sep. 23, 2022 for U.S. Appl. No. 17/262,178 (pp. 1-7).
Office Action (Non-Final Rejection) dated Nov. 8, 2022 for U.S. Appl. No. 17/343,344 (pp. 1-7).
Office Action (Notice of Allowance and Fees Due (PTOL-85)) dated Nov. 16, 2022 for U.S. Appl. No. 17/211,521 (pp. 1-8).
Office Action (Non-Final Rejection) dated Dec. 6, 2022 for U.S. Appl. No. 17/352,049 (pp. 1-8).
Office Action (Non-Final Rejection) dated Dec. 30, 2022 for U.S. Appl. No. 17/351,920 (pp. 1-8).
Office Action (Non-Final Rejection) dated Jan. 17, 2023 for U.S. Appl. No. 17/347,321 (pp. 1-22).
Office Action (Non-Final Rejection) dated Jan. 23, 2023 for U.S. Appl. No. 17/368,393 (pp. 1-6).
Office Action (Notice of Allowance and Fees Due (PTOL-85)) dated Jan. 20, 2023 for U.S. Appl. No. 17/362,486 (pp. 1-8).
Office Action (Notice of Allowance and Fees Due (PTOL-85)) dated Jan. 23, 2023 for U.S. Appl. No. 17/362,530 (pp. 1-9).
Office Action (Notice of Allowance and Fees Due (PTOL-85)) dated Jan. 30, 2023 for U.S. Appl. No. 17/362,486 (pp. 1-2).
Office Action (Notice of Allowance and Fees Due (PTOL-85)) dated Feb. 1, 2023 for U.S. Appl. No. 17/362,530 (pp. 1-2).
Office Action (Notice of Allowance and Fees Due (PTOL-85)) dated Feb. 21, 2023 for U.S. Appl. No. 17/351,920 (pp. 1-5).
Office Action (Notice of Allowance and Fees Due (PTOL-85)) dated Mar. 13, 2023 for U.S. Appl. No. 17/343,344 (pp. 1-5).
Office Action (Final Rejection) dated Mar. 17, 2023 for U.S. Appl. No. 17/219,634 (pp. 1-15).
Office Action (Notice of Allowance and Fees Due (PTOL-85)) dated Mar. 27, 2023 for U.S. Appl. No. 17/352,049 (pp. 1-5).
Office Action (Non-Final Rejection) dated Apr. 7, 2023 for U.S. Appl. No. 17/647,568 (pp. 1-6).

* cited by examiner

SYSTEMS AND METHODS FOR SECURELY CONNECTING AN ELECTRONIC GAMING MACHINE TO AN END USER DEVICE

CROSS-REFERENCE TO RELATED APPLICATIONS

This application is a continuation of and claims priority to U.S. patent application Ser. No. 17/220,778, filed Apr. 1, 2021, which claims the benefit of U.S. Provisional Patent Application No. 63/024,860, filed May 14, 2020 and U.S. Provisional Patent Application No. 63/005,008, filed Apr. 3, 2020, the contents of which are incorporated herein by reference in their entireties.

TECHNICAL FIELD

The field of disclosure relates generally to electronic gaming, and more particularly, to systems and methods for securely connecting an electronic gaming machine (EGM) to an end user device (EUD) such that a user interface (UI) for the EGM is displayed on the end user device.

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In some cases, a player may qualify for a special mode of the base game, a secondary game, or a bonus round of the base game by attaining a certain winning combination or triggering event in, or related to, the base game, or after the player is randomly awarded the special mode, secondary game, or bonus round. In the special mode, secondary game, or bonus round, the player is given an opportunity to win extra game credits, game tokens or other forms of payout. In the case of "game credits" that are awarded during play, the game credits are typically added to a credit meter total on the EGM and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player over the course of many plays or instances of the game, which is generally referred to as return to player (RTP). The RTP and randomness of the RNG ensure the fairness of the games and are highly regulated. Upon initiation of play, the RNG randomly determines a game outcome and symbols are then selected which correspond to that outcome. Notably, some games may include an element of skill on the part of the player and are therefore not entirely random.

BRIEF DESCRIPTION

In one aspect, an electronic gaming system is described. The electronic gaming system includes a casino management server configured to generate beacon identifiers (IDs) and an electronic casino device. The electronic casino device includes a beacon configured to wirelessly communicate with end user devices (EUDs) of players and at least one processor. The at least one processor executes instructions which cause the at least one processor to transmit a request for a custom beacon ID to the casino management server, receive the custom beacon ID from the casino management server in response to the request, and cause the beacon to wirelessly transmit the custom beacon ID to the EUD. The casino management server is configured to receive, from the EUD of the player, a connection request that includes a received beacon ID as received by the EUD based on the transmitting and validate that the received beacon ID matches the custom beacon ID. The casino management server is further configured to store a valid association between the EUD of the player and the electronic casino device in a database and receive instructions from the EUD, based on player interaction with the EUD, such that the player plays a game operated on the electronic casino device by physically interacting with the EUD, wherein the instructions received from the EUD include a low-bandwidth instruction including no more than two bytes.

In another aspect, a method of a casino management server controlling an electronic casino device is described. The method includes receiving a request for a custom beacon ID from the electronic casino device and transmitting a custom beacon ID to the electronic casino device, wherein in response to receiving the custom beacon ID, the electronic casino device is configured to configure a beacon of the electronic casino device to cause the beacon to wirelessly transmit the custom beacon ID to an end user device (EUD) of a player. The method further includes receiving, from the EUD of the player, a connection request that includes a received beacon ID as received by the EUD from the beacon and validating that the received beacon ID matches the custom beacon ID transmitted to the electronic casino device. The method also includes receiving instructions from the EUD, based on player interaction with the EUD, such that the player plays a game operated on the electronic casino device by physically interacting with the EUD, wherein the instructions received from the EUD include a low-bandwidth instruction including no more than two bytes.

In yet another aspect, an electronic casino device is described. The electronic casino device includes an end user device (EUD) relay device coupled to a wiring harness of a button deck of the electronic casino device via an input connector including one or more button input paths. The EUD relay device is configured to establish a wireless connection with the EUD and receive, from the EUD, a virtual button press event including a button identifier of a virtual button pressed on a graphical user interface of the EUD. The EUD relay device is also configured to identify a first button output signal path of one or more button output signal paths based on the button identifier included in the virtual button press event, wherein each button output signal path of the one or more button output signal paths corresponds to a button input signal path of the one or more button input paths and generate a button press signal on the first button output signal path, thereby emulating a button press from a button deck of the electronic casino device.

DETAILED DESCRIPTION

Figure 1:
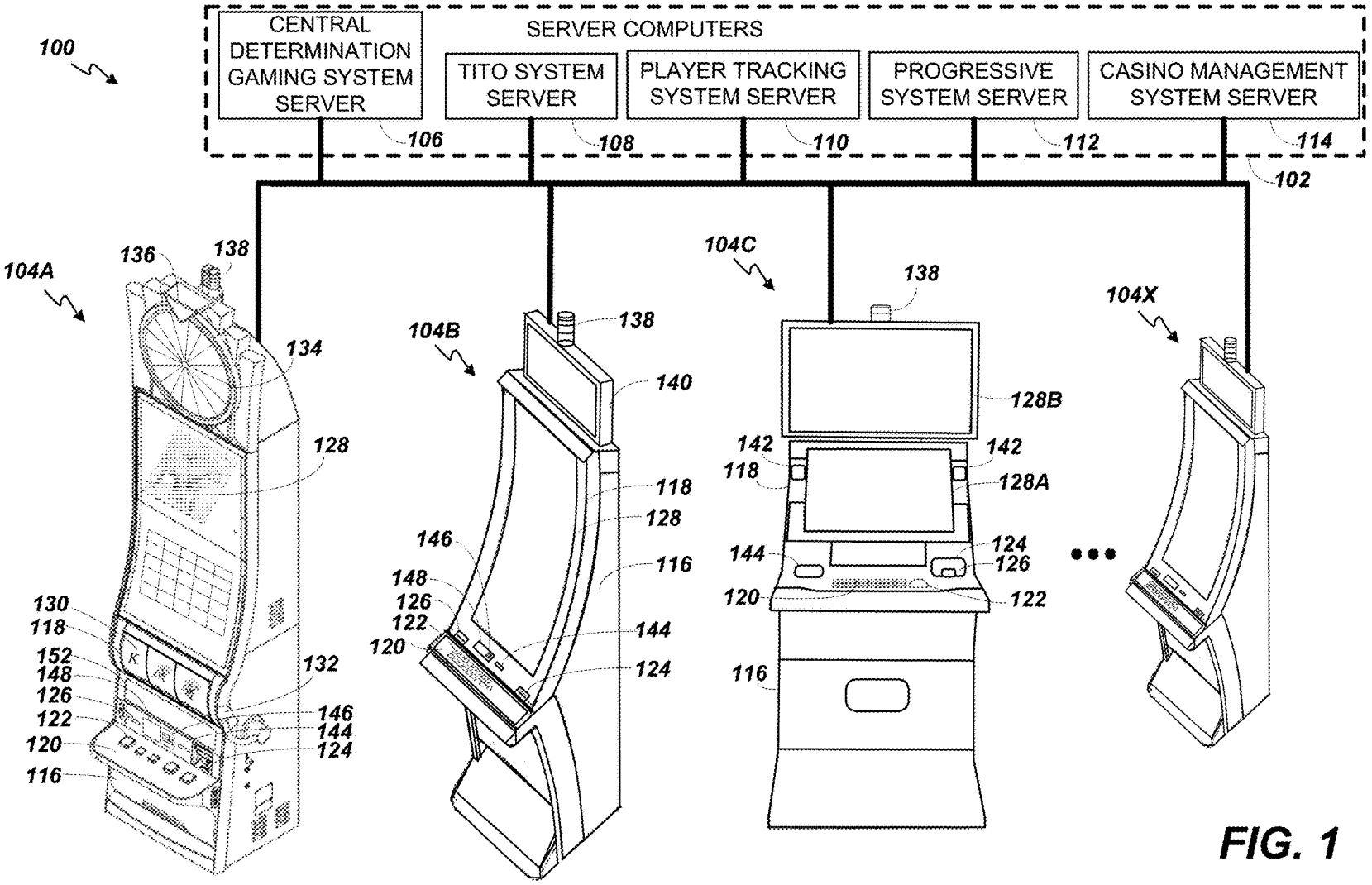
FIG. 1 is an exemplary diagram showing several EGMs networked with various gaming related servers.

Embodiments of the present disclosure provide systems and methods for securely connecting an electronic gaming machine (EGM) to an end user device (EUD) such that a user interface (UI) for the EGM is displayed on the end user device. During play of an electronic game on an EGM, a player may wish to play the game while not having to physically contact components of the EGM itself (e.g., a touch screen, buttons, a bill validator, a receipt printer, etc.). The present disclosure provides players with an option of playing an electronic game on an EGM without needing to physically touch the EGM at all. As described herein, an EGM includes a beacon that transmits a signal within a predefined range of the EGM (e.g., a playing distance) that is received at an EUD (e.g., a cell phone, tablet, other mobile computing device, and/or any other computerized platform) of a player. Upon the EUD receiving the signal from the beacon, the player may connect to the EGM (e.g., by selecting "connect" as displayed on the end user device).

The end user device may then connect to at least one of the EGM itself, or a casino network in communication with the EGM. Data sent from the network and/or EGM to the EUD, and vice versa, may be low bandwidth in order to ensure reliable communication between devices. For example, the data sent could be a single packet constructed with a network communication header and/or footer (e.g., Ethernet header, sender and/or recipient IP addresses, protocol format of the ID and/or payload, etc.), EGM device information, I/O command, and other button data. In some embodiments, the button data could be one bit long for each button (e.g., one bit is designated for each button on the EGM and/or displayed on the EUD, thereby facilitating low-bandwidth communication).

In other words, each transmission (e.g., from the beacon to the EUD and/or from the EUD to the server) may include a message header and a message payload. In some embodiments, the message header includes a 2-byte message type indicator (e.g., a code identifying the message as a switch status communication), and the message payload includes a 2-byte custom (machine) ID (e.g., a code identifying the target EGM, as received from the BT beacon), a 2-byte switch panel layout code (e.g., defining a switch panel configuration), and 2-bytes containing the switch status data. The message header or message payload may include fewer, greater, and/or alternative data fields that facilitate the embodiments described herein (e.g., resulting in fewer/greater bytes, such as 1 byte).

The player is then able to play at least one game provided by the EGM through the EUD, and does not need to touch the EGM at all. For example, a player may be able to transfer funds from a player account via the EUD to the EGM for play of a game thereon. A player may receive any award presented by the EGM at the EUD. During play of a game, any user interface provided by the EGM may be displayed on the EUD (e.g., a button, a button deck, pay line options, wager amount options, etc.). Accordingly, the player never needs to come in contact with the EGM, and instead only needs to contact a trusted EUD.

In one example embodiment, a server (e.g., casino management server) provides a network protocol for the messages broadcast by the beacons described herein. Each broadcast may include a message header and a message payload (e.g., all of which may be a payload to a lower layered protocol for the wireless communications). In some embodiments, the message includes a 1-byte ID indicator (e.g., a flag or code indicating whether a custom ID is included in the message payload) and/or a 1-byte code (e.g., defining other data included in the message). When a custom ID is indicated as being included in the message payload, the first M bits and/or bytes of the message payload are read as a custom ID, where M is a predetermined number of bits and/or bytes sufficient to store unique custom IDs for the beacons. The message header or message payload may include additional or alternative data fields that facilitate the embodiments described herein.

In some embodiments, a beacon transmission can be configured using a command sent to a beacon transmitter (e.g., from a player tracking interface controlling the beacon transmitter). Multiple beacon frames can be configured (e.g., for messages having payload exceeding the capacity of a single frame). As an illustration, in an advertising embodiment, a 41 byte command packet can be used, with byte 0 specifying a frame, bytes 1-9 specifying a security code ("PIN") of the transmitter, and bytes 10-40 specifying 31 bytes to be transmitted, sometimes called the "advertisement" of the beacon. Within the 31 byte advertisement, various fields can include one or more of: advertisement length, frame number, manufacturer code, beacon type, a transmitter identifier, an Internet protocol address ("IP address"), a transmit power, action ID, other payload, or other fields. One or more such fields can be omitted, or other fields can be introduced. This advertisement format is merely illustrative, and other formats, lengths, and frame configurations can be used.

Where multiple frames are used, they can be independently activated. To illustrate, a beacon transmitter can store one default frame for transmissions to patrons not registered at a proximate gaming device, another custom frame for transmissions to a registered patron who may be playing on the gaming device, and a further custom frame for a particular promotion unrelated to the gaming device, and the frames can be selectively transmitted or transmitted in rotation. In some embodiments, multiple frames may be used for a single interaction event. For example, a message payload that includes a URL for a particular interaction event may be too large to fit within a 31 byte advertisement field of a single frame. Accordingly, such interaction events may configure multiple frames to provide a single interaction event by breaking up the message payload across multiple advertisement fields of those frames and the receiving mobile device 320 can reform the message payload by combining the content of those multiple frames. The beacon transmitter can acknowledge a received command packet.

The advent of one-way wireless technologies, sometimes referred to as beacons, within widely deployed technologies such as Bluetooth® can significantly alleviate a number of problems with casino wireless deployments and can provide additional opportunities for improving the user experience. Bluetooth® beacons are inherently low-power, low-range transmissions for which the transmission power can be controlled so that a reception range of a few meters (m) can be achieved, and interference between beacons in a crowded casino environment can be minimized. Additionally, protocols for one-way beacon transmissions are considerably simpler than those associated with bidirectional messaging. Particularly, such protocols are free of handshakes and do not require a receiving user device to enable a power-consuming Bluetooth® transmitter at any time.

Thus, one-way beacons can improve the local communication process between an electronic gaming device and a nearby patron, as patrons come and go, pass through a casino, start play, or move on to another gaming device. Different aspects of the disclosed technologies can be implemented on the side of the electronic gaming device (in some examples, including a beacon transmitter in an associated player tracking interface) and on the side of the patron's personal device (e.g., an EUD) and/or installed app (e.g., a casino app). In the examples described herein, advantages can be realized through the localized communication range, low power consumption, and lightweight protocol. One-way beacon communication can be complementary to other wireless technologies and can be used alongside cellular telephony, Wi-Fi, and NFC, each fulfilling different sets of requirements. For example, Bluetooth® is operable at a significantly greater range, commonly around 10 m, as compared to NFC, commonly around 10 cm.

Further, low-bandwidth communications transmitted over a Wi-Fi network increase the efficiency in which such messages are transmitted across the network (e.g., messages including less data are transmitted more quickly than messages including more data). Accordingly, the systems and methods described herein provide for low-bandwidth communications not only from a beacon to an EUD, but also from an EUD to a backend server. For example, once an EUD is connected to the backend server, messages from the EUD to the backend server may include only one bit dedicated to each button displayed on the EUD (e.g., virtual buttons displayed on a virtual button deck on an EUD). For example, one bit of a low-bandwidth message may be dedicated to a bet up button, one bit may be dedicated to a bet down button, one bit may be dedicated to a spin button, one bit may be dedicated to a cash out button, etc. Accordingly, in addition to the low-bandwidth, one-way communications from a beacon to an EUD described herein, low-bandwidth communications are also envisioned as being transmitted from an EUD to a backend server (e.g., and then from the backend server to a gaming device), thereby causing the messages to be transmitted more quickly and efficiently than other messages that may be being transmitted across the Wi-Fi network.

In other words, an example embodiment described herein utilizes low-bandwidth, one-way communication from a beacon to an EUD (e.g., no more than two bytes per communication), and further low-bandwidth communication from an EUD to a server. For example, minimal amounts of data are transmitted from a beacon to an EUD (e.g., a custom ID) in order for an EUD to establish a connection with an EGM coupled to the beacon (e.g., via a casino management server). Once a connection between an EUD and an EGM is established, data regarding gameplay (e.g., connected actions, according to inputs at the EUD) may be transmitted over a public and or private network (e.g., Wi-Fi network). Communications form an EUD to an EGM (e.g., via a casino management server) may also be low bandwidth (e.g., placing a low data load on an existing network, such as on a 1.2 mb/s data rate network communication channel the data transmitted from the EUD to the server may only use 2 kb/s (e.g. <0.1%), assuming the switch data was sent at a rate of 30 times per second). Accordingly, minimal amounts of data are transmitted from a beacon to an EUD (e.g., allowing for the use of low-cost beacons with one-way communication) and from an EUD to a server (e.g., resulting in quicker transmission speeds and efficiency over a Wi-Fi network). Further, existing EGMs may be retrofitted with the beacons in order to enable embodiments described herein (e.g., no new EGMs need to be put in place in order to implement embodiments described herein).

FIG. 1 illustrates several different models of EGMs which may be networked to various gaming related servers. Shown is a system 100 in a gaming environment including one or more server computers 102 (e.g., slot servers of a casino) that are in communication, via a communications network, with one or more gaming devices 104A-104X (EGMs, slots, video poker, bingo machines, etc.) that can implement one or more aspects of the present disclosure. The gaming devices 104A-104X may alternatively be portable and/or remote gaming devices such as, but not limited to, a smart phone, a tablet, a laptop, or a game console. Gaming devices 104A-104X utilize specialized software and/or hardware to form non-generic, particular machines or apparatuses that comply with regulatory requirements regarding devices used for wagering or games of chance that provide monetary awards.

Communication between the gaming devices 104A-104X and the server computers 102, and among the gaming devices 104A-104X, may be direct or indirect using one or more communication protocols. As an example, gaming devices 104A-104X and the server computers 102 can communicate over one or more communication networks, such as over the Internet through a website maintained by a computer on a remote server or over an online data network including commercial online service providers, Internet service providers, private networks (e.g., local area networks and enterprise networks), and the like (e.g., wide area networks). The communication networks could allow gaming devices 104A-104X to communicate with one another and/or the server computers 102 using a variety of communication-based technologies, such as radio frequency (RF) (e.g., wireless fidelity (Wi-Fi®) and Bluetooth®), cable TV, satellite links and the like.

In some implementation, server computers 102 may not be necessary and/or preferred. For example, in one or more implementations, a stand-alone gaming device such as gaming device 104A, gaming device 104B or any of the other gaming devices 104C-104X can implement one or more aspects of the present disclosure. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door which provides access to the interior of the cabinet. Gaming device 104A typically includes a button area or button deck 120 accessible by a player that is configured with input switches or buttons 122, an access channel for a bill validator 124, and/or an access channel for a ticket-out printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The mechanical reels 130 are independently spun and stopped to show a set of symbols within the gaming display area 118 which may be used to determine an outcome to the game.

In many configurations, the gaming device 104A may have a main display 128 (e.g., video display monitor) mounted to, or above, the gaming display area 118. The main display 128 can be a high-resolution liquid crystal display (LCD), plasma, light emitting diode (LED), or organic light emitting diode (OLED) panel which may be flat or curved as shown, a cathode ray tube, or other conventional electronically controlled video monitor.

In some implementations, the bill validator 124 may also function as a "ticket-in" reader that allows the player to use a casino issued credit ticket to load credits onto the gaming device 104A (e.g., in a cashless ticket ("TITO") system). In such cashless implementations, the gaming device 104A may also include a "ticket-out" printer 126 for outputting a credit ticket when a "cash out" button is pressed. Cashless TITO systems are used to generate and track unique barcodes or other indicators printed on tickets to allow players to avoid the use of bills and coins by loading credits using a ticket reader and cashing out credits using a ticket-out printer 126 on the gaming device 104A. The gaming device 104A can have hardware meters for purposes including ensuring regulatory compliance and monitoring the player credit balance. In addition, there can be additional meters that record the total amount of money wagered on the gaming device, total amount of money deposited, total amount of money withdrawn, total amount of winnings on gaming device 104A.

In some implementations, a player tracking card reader 144, a transceiver for wireless communication with a mobile device (e.g., a player's smartphone), a keypad 146, and/or an illuminated display 148 for reading, receiving, entering, and/or displaying player tracking information is provided in gaming device 104A. In such implementations, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some implementations, the information panel(s) 152 may be implemented as an additional video display.

Gaming devices 104A have traditionally also included a handle 132 typically mounted to the side of main cabinet 116 which may be used to initiate game play.

Figure 2A:
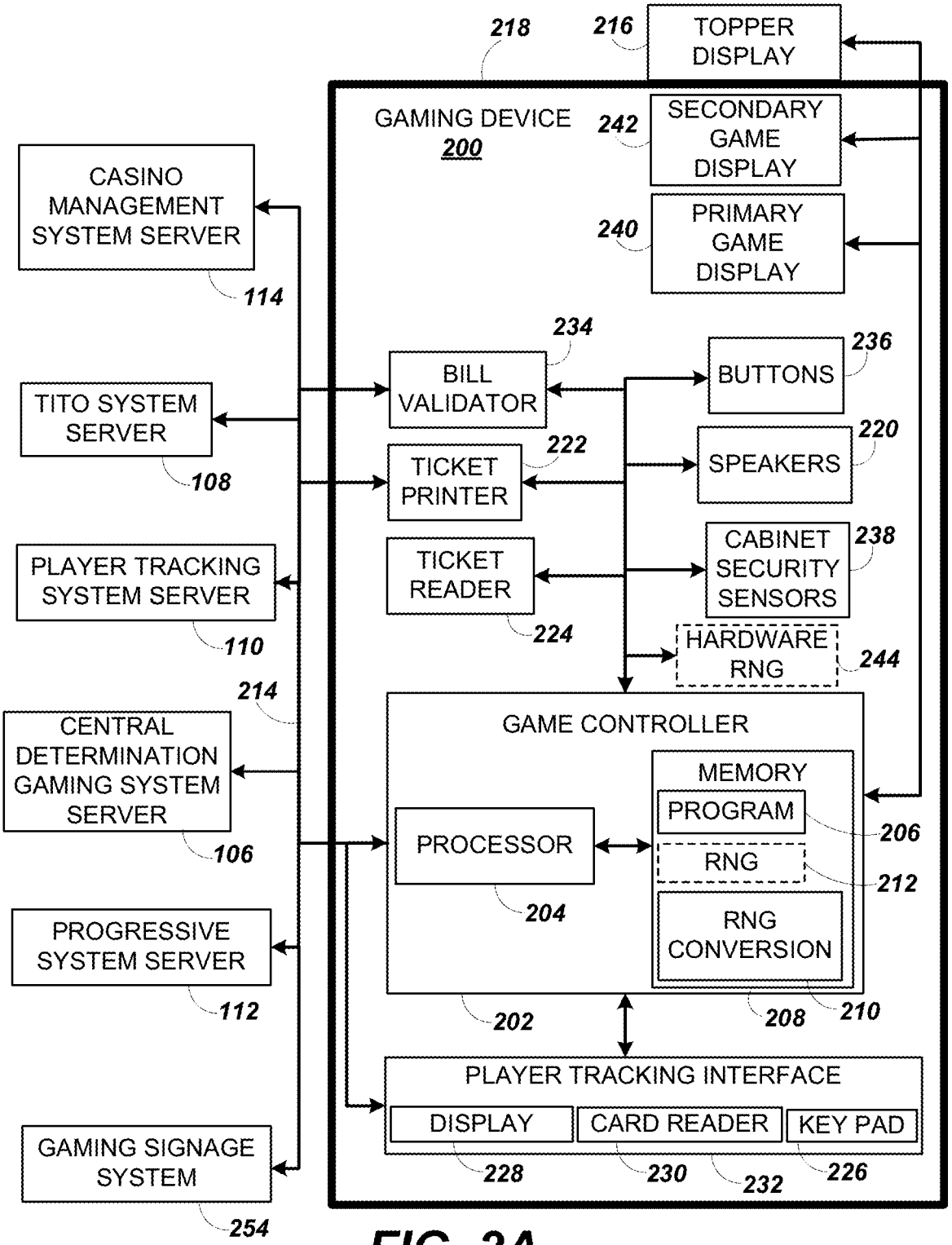
FIG. 2A is a block diagram showing various functional elements of an exemplary EGM.

Many or all the above described components can be controlled by circuitry (e.g., a game controller) housed inside the main cabinet 116 of the gaming device 104A, the details of which are shown in FIG. 2A.

An alternative example gaming device 104B illustrated in FIG. 1 is the Arc™ model gaming device manufactured by Aristocrat® Technologies, Inc. Note that where possible, reference numerals identifying similar features of the gaming device 104A implementation are also identified in the gaming device 104B implementation using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some implementations, the optional topper screen 140 may also or alternatively be used to display progressive jackpot prizes available to a player during play of gaming device 104B.

Example gaming device 104B includes a main cabinet 116 including a main door which opens to provide access to the interior of the gaming device 104B. The main or service door is typically used by service personnel to refill the ticket-out printer 126 and collect bills and tickets inserted into the bill validator 124. The main or service door may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the main display 128A may have a curvature radius from top to bottom, or alternatively from side to side. In some implementations, main display 128A is a flat panel display. Main display 128A is typically used for primary game play while secondary display 128B is typically used for bonus game play, to show game features or attraction activities while the game is not in play or any other information or media desired by the game designer or operator. In some implementations, example gaming device 104C may also include speakers 142 to output various audio such as game sound, background music, etc.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2A is a block diagram depicting exemplary internal electronic components of a gaming device 200 connected to various external systems. All or parts of the gaming device 200 shown could be used to implement any one of the example gaming devices 104A-X depicted in FIG. 1. As shown in FIG. 2A, gaming device 200 includes a topper display 216 or another form of a top box (e.g., a topper wheel, a topper screen, etc.) that sits above cabinet 218. Cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. Player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. FIG. 2 also depicts utilizing a ticket printer 222 to print tickets for a TITO system server 108. Gaming device 200 may further include a bill validator 234, player-input buttons 236 for player input, cabinet security sensors 238 to detect unauthorized opening of the cabinet 218, a primary game display 240, and a secondary game display 242, each coupled to and operable under the control of game controller 202.

The games available for play on the gaming device 200 are controlled by a game controller 202 that includes one or more processors 204. Processor 204 represents a general-purpose processor, a specialized processor intended to perform certain functional tasks, or a combination thereof. As an example, processor 204 can be a central processing unit (CPU) that has one or more multi-core processing units and memory mediums (e.g., cache memory) that function as buffers and/or temporary storage for data. Alternatively, processor 204 can be a specialized processor, such as an application specific integrated circuit (ASIC), graphics processing unit (GPU), field-programmable gate array (FPGA), digital signal processor (DSP), or another type of hardware accelerator. In another example, processor 204 is a system on chip (SoC) that combines and integrates one or more general-purpose processors and/or one or more specialized processors. Although FIG. 2A illustrates that game controller 202 includes a single processor 204, game controller 202 is not limited to this representation and instead can include multiple processors 204 (e.g., two or more processors).

FIG. 2A illustrates that processor 204 is operatively coupled to memory 208. Memory 208 is defined herein as including volatile and nonvolatile memory and other types of non-transitory data storage components. Volatile memory is memory that do not retain data values upon loss of power. Nonvolatile memory is memory that do retain data upon a loss of power. Examples of memory 208 include random access memory (RAM), read-only memory (ROM), hard disk drives, solid-state drives, universal serial bus (USB) flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, examples of RAM include static random access memory (SRAM), dynamic random access memory (DRAM), magnetic random access memory (MRAM), and other such devices. Examples of ROM include a programmable read-only memory (PROM), an erasable programmable read-only memory (EPROM), an electrically erasable programmable read-only memory (EEPROM), or other like memory device. Even though FIG. 2A illustrates that game controller 202 includes a single memory 208, game controller 202 could include multiple memories 208 for storing program instructions and/or data.

Memory 208 can store one or more game programs 206 that provide program instructions and/or data for carrying out various implementations (e.g., game mechanics) described herein. Stated another way, game program 206 represents an executable program stored in any portion or component of memory 208. In one or more implementations, game program 206 is embodied in the form of source code that includes human-readable statements written in a programming language or machine code that contains numerical instructions recognizable by a suitable execution system, such as a processor 204 in a game controller or other system. Examples of executable programs include: (1) a compiled program that can be translated into machine code in a format that can be loaded into a random access portion of memory 208 and run by processor 204; (2) source code that may be expressed in proper format such as object code that is capable of being loaded into a random access portion of memory 208 and executed by processor 204; and (3) source code that may be interpreted by another executable program to generate instructions in a random access portion of memory 208 to be executed by processor 204.

Alternatively, game programs 206 can be set up to generate one or more game instances based on instructions and/or data that gaming device 200 exchanges with one or more remote gaming devices, such as a central determination gaming system server 106 (not shown in FIG. 2A but shown in FIG. 1). For purpose of this disclosure, the term "game instance" refers to a play or a round of a game that gaming device 200 presents (e.g., via a user interface (UI)) to a player. The game instance is communicated to gaming device 200 via the network 214 and then displayed on gaming device 200. For example, gaming device 200 may execute game program 206 as video streaming software that allows the game to be displayed on gaming device 200. When a game is stored on gaming device 200, it may be loaded from memory 208 (e.g., from a read only memory (ROM)) or from the central determination gaming system server 106 to memory 208.

Gaming devices, such as gaming device 200, are highly regulated to ensure fairness and, in many cases, gaming device 200 is operable to award monetary awards (e.g., typically dispensed in the form of a redeemable voucher). Therefore, to satisfy security and regulatory requirements in a gaming environment, hardware and software architectures are implemented in gaming devices 200 that differ significantly from those of general-purpose computers. Adapting general purpose computers to function as gaming devices 200 is not simple or straightforward because of: (1) the regulatory requirements for gaming devices 200, (2) the harsh environment in which gaming devices 200 operate, (3) security requirements, (4) fault tolerance requirements, and (5) the requirement for additional special purpose componentry enabling functionality of an EGM. These differences require substantial engineering effort with respect to game design implementation, game mechanics, hardware components, and software.

One regulatory requirement for games running on gaming device 200 generally involves complying with a certain level of randomness. Typically, gaming jurisdictions mandate that gaming devices 200 satisfy a minimum level of randomness without specifying how a gaming device 200 should achieve this level of randomness. To comply, FIG. 2A illustrates that gaming device 200 could include an RNG 212 that utilizes hardware and/or software to generate RNG outcomes that lack any pattern. The RNG operations are often specialized and non-generic in order to comply with regulatory and gaming requirements. For example, in a slot game, game program 206 can initiate multiple RNG calls to RNG 212 to generate RNG outcomes, where each RNG call and RNG outcome corresponds to an outcome for a reel. In another example, gaming device 200 can be a Class II gaming device where RNG 212 generates RNG outcomes for creating Bingo cards. In one or more implementations, RNG 212 could be one of a set of RNGs operating on gaming device 200. More generally, an output of the RNG 212 can be the basis on which game outcomes are determined by the game controller 202. Game developers could vary the degree of true randomness for each RNG (e.g., pseudorandom) and utilize specific RNGs depending on game requirements. The output of the RNG 212 can include a random number or pseudorandom number (either is generally referred to as a "random number").

In FIG. 2A, RNG 212 and hardware RNG 244 are shown in dashed lines to illustrate that RNG 212, hardware RNG 244, or both can be included in gaming device 200. In one implementation, instead of including RNG 212, gaming device 200 could include a hardware RNG 244 that generates RNG outcomes. Analogous to RNG 212, hardware RNG 244 performs specialized and non-generic operations in order to comply with regulatory and gaming requirements. For example, because of regulation requirements, hardware RNG 244 could be a random number generator that securely produces random numbers for cryptography use. The gaming device 200 then uses the secure random numbers to generate game outcomes for one or more game features. In another implementation, the gaming device 200 could include both hardware RNG 244 and RNG 212. RNG 212 may utilize the RNG outcomes from hardware RNG 244 as one of many sources of entropy for generating secure random numbers for the game features.

Another regulatory requirement for running games on gaming device 200 includes ensuring a certain level of RTP. Similar to the randomness requirement discussed above, numerous gaming jurisdictions also mandate that gaming device 200 provides a minimum level of RTP (e.g., RTP of at least 75%). A game can use one or more lookup tables (also called weighted tables) as part of a technical solution that satisfies regulatory requirements for randomness and RTP. In particular, a lookup table can integrate game features (e.g., trigger events for special modes or bonus games; newly introduced game elements such as extra reels, new symbols, or new cards; stop positions for dynamic game elements such as spinning reels, spinning wheels, or shifting reels; or card selections from a deck) with random numbers generated by one or more RNGs, so as to achieve a given level of volatility for a target level of RTP. (In general, volatility refers to the frequency or probability of an event such as a special mode, payout, etc. For example, for a target level of RTP, a higher-volatility game may have a lower payout most of the time with an occasional bonus having a very high payout, while a lower-volatility game has a steadier payout with more frequent bonuses of smaller amounts.) Configuring a lookup table can involve engineering decisions with respect to how RNG outcomes are mapped to game outcomes for a given game feature, while still satisfying regulatory requirements for RTP. Configuring a lookup table can also involve engineering decisions about whether different game features are combined in a given entry of the lookup table or split between different entries (for the respective game features), while still satisfying regulatory requirements for RTP and allowing for varying levels of game volatility.

FIG. 2A illustrates that gaming device 200 includes an RNG conversion engine 210 that translates the RNG outcome from RNG 212 to a game outcome presented to a player. To meet a designated RTP, a game developer can set up the RNG conversion engine 210 to utilize one or more lookup tables to translate the RNG outcome to a symbol element, stop position on a reel strip layout, and/or randomly chosen aspect of a game feature. As an example, the lookup tables can regulate a prize payout amount for each RNG outcome and how often the gaming device 200 pays out the prize payout amounts. The RNG conversion engine 210 could utilize one lookup table to map the RNG outcome to a game outcome displayed to a player and a second lookup table as a pay table for determining the prize payout amount for each game outcome. The mapping between the RNG outcome to the game outcome controls the frequency in hitting certain prize payout amounts.

FIG. 2A also depicts that gaming device 200 is connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

When a player wishes to play the gaming device 200, he/she can insert cash or a ticket voucher through a coin acceptor (not shown) or bill validator 234 to establish a credit balance on the gaming device. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views with one or more UIs, the game outcome on one or more of the primary game display 240 and secondary game display 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Additionally, or alternatively, gaming devices 104A-104X and 200 can include or be coupled to one or more wireless transmitters, receivers, and/or transceivers (not shown in FIGS. 1 and 2A) that communicate (e.g., Bluetooth® or other near-field communication technology) with one or more mobile devices to perform a variety of wireless operations in a casino environment. Examples of wireless operations in a casino environment include detecting the presence of mobile devices, performing credit, points, comps, or other marketing or hard currency transfers, establishing wagering sessions, and/or providing a personalized casino-based experience using a mobile application. In one implementation, to perform these wireless operations, a wireless transmitter or transceiver initiates a secure wireless connection between a gaming device 104A-104X and 200 and a mobile device. After establishing a secure wireless connection between the gaming device 104A-104X and 200 and the mobile device, the wireless transmitter or transceiver does not send and/or receive application data to and/or from the mobile device. Rather, the mobile device communicates with gaming devices 104A-104X and 200 using another wireless connection (e.g., WiFi® or cellular network). In another implementation, a wireless transceiver establishes a secure connection to directly communicate with the mobile device. The mobile device and gaming device 104A-104X and 200 sends and receives data utilizing the wireless transceiver instead of utilizing an external network. For example, the mobile device would perform digital wallet transactions by directly communicating with the wireless transceiver. In one or more implementations, a wireless transmitter could broadcast data received by one or more mobile devices without establishing a connection with the mobile devices.

Although FIGS. 1 and 2A illustrate specific implementations of a gaming device (e.g., gaming devices 104A-104X and 200), the disclosure is not limited to those implementations shown in FIGS. 1 and 2. For example, not all gaming devices suitable for implementing implementations of the present disclosure necessarily include top wheels, top boxes, information panels, cashless ticket systems, and/or player tracking systems. Further, some suitable gaming devices have only a single game display that includes only a mechanical set of reels and/or a video display, while others are designed for bar counters or tabletops and have displays that face upwards. Gaming devices 104A-104X and 200 may also include other processors that are not separately shown. Using FIG. 2A as an example, gaming device 200 could include display controllers (not shown in FIG. 2A) configured to receive video input signals or instructions to display images on game displays 240 and 242. Alternatively, such display controllers may be integrated into the game controller 202. The use and discussion of FIGS. 1 and 2 are examples to facilitate ease of description and explanation.

Figure 2B:
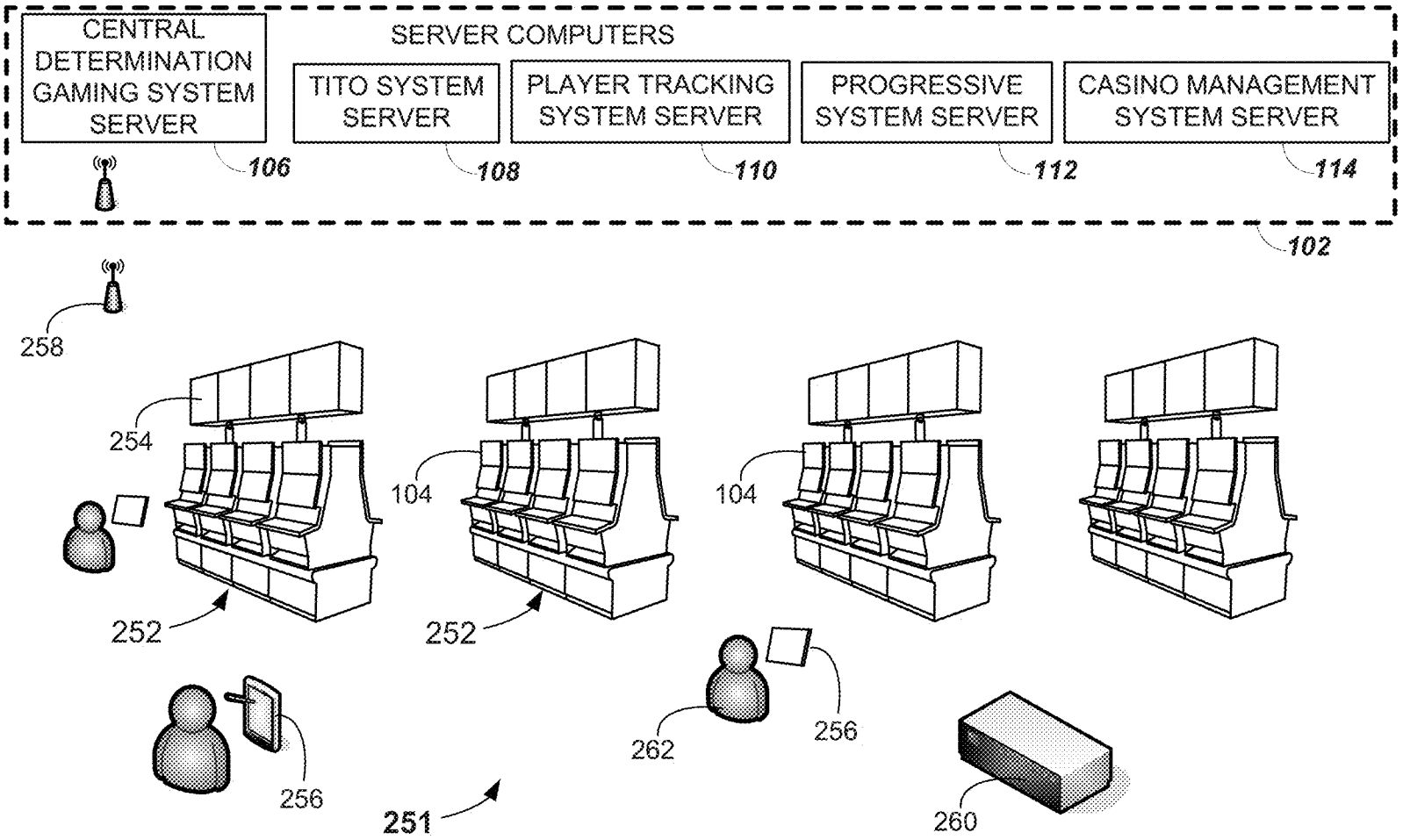
FIG. 2B depicts a casino gaming environment according to one example.

FIG. 2B depicts a casino gaming environment according to one example. In this example, the casino 251 includes banks 252 of EGMs 104. In this example, each bank 252 of EGMs 104 includes a corresponding gaming signage system 254 (also shown in FIG. 2A). According to this implementation, the casino 251 also includes mobile gaming devices 256, which are also configured to present wagering games in this example. The mobile gaming devices 256 may, for example, include tablet devices, cellular phones, smart phones and/or other handheld devices. In this example, the mobile gaming devices 256 are configured for communication with one or more other devices in the casino 251, including but not limited to one or more of the server computers 102, via wireless access points 258.

According to some examples, the mobile gaming devices 256 may be configured for stand-alone determination of game outcomes. However, in some alternative implementations the mobile gaming devices 256 may be configured to receive game outcomes from another device, such as the central determination gaming system server 106, one of the EGMs 104, etc.

Some mobile gaming devices 256 may be configured to accept monetary credits from a credit or debit card, via a wireless interface (e.g., via a wireless payment app), via tickets, via a patron casino account, etc. However, some mobile gaming devices 256 may not be configured to accept monetary credits via a credit or debit card. Some mobile gaming devices 256 may include a ticket reader and/or a ticket printer whereas some mobile gaming devices 256 may not, depending on the particular implementation.

In some implementations, the casino 251 may include one or more kiosks 260 that are configured to facilitate monetary transactions involving the mobile gaming devices 256, which may include cash out and/or cash in transactions. The kiosks 260 may be configured for wired and/or wireless communication with the mobile gaming devices 256. The kiosks 260 may be configured to accept monetary credits from casino patrons 262 and/or to dispense monetary credits to casino patrons 262 via cash, a credit or debit card, via a wireless interface (e.g., via a wireless payment app), via tickets, etc. According to some examples, the kiosks 260 may be configured to accept monetary credits from a casino patron and to provide a corresponding amount of monetary credits to a mobile gaming device 256 for wagering purposes, e.g., via a wireless link such as a near-field communications link. In some such examples, when a casino patron 262 is ready to cash out, the casino patron 262 may select a cash out option provided by a mobile gaming device 256, which may include a real button or a virtual button (e.g., a button provided via a graphical user interface) in some instances. In some such examples, the mobile gaming device 256 may send a "cash out" signal to a kiosk 260 via a wireless link in response to receiving a "cash out" indication from a casino patron. The kiosk 260 may provide monetary credits to the casino patron 262 corresponding to the "cash out" signal, which may be in the form of cash, a credit ticket, a credit transmitted to a financial account corresponding to the casino patron, etc.

In some implementations, a cash-in process and/or a cash-out process may be facilitated by the TITO system server 108. For example, the TITO system server 108 may control, or at least authorize, ticket-in and ticket-out transactions that involve a mobile gaming device 256 and/or a kiosk 260.

Some mobile gaming devices 256 may be configured for receiving and/or transmitting player loyalty information. For example, some mobile gaming devices 256 may be configured for wireless communication with the player tracking system server 110. Some mobile gaming devices 256 may be configured for receiving and/or transmitting player loyalty information via wireless communication with a patron's player loyalty card, a patron's smartphone, etc.

According to some implementations, a mobile gaming device 256 may be configured to provide safeguards that prevent the mobile gaming device 256 from being used by an unauthorized person. For example, some mobile gaming devices 256 may include one or more biometric sensors and may be configured to receive input via the biometric sensor (s) to verify the identity of an authorized patron. Some mobile gaming devices 256 may be configured to function only within a predetermined or configurable area, such as a casino gaming area.

Figure 2C:
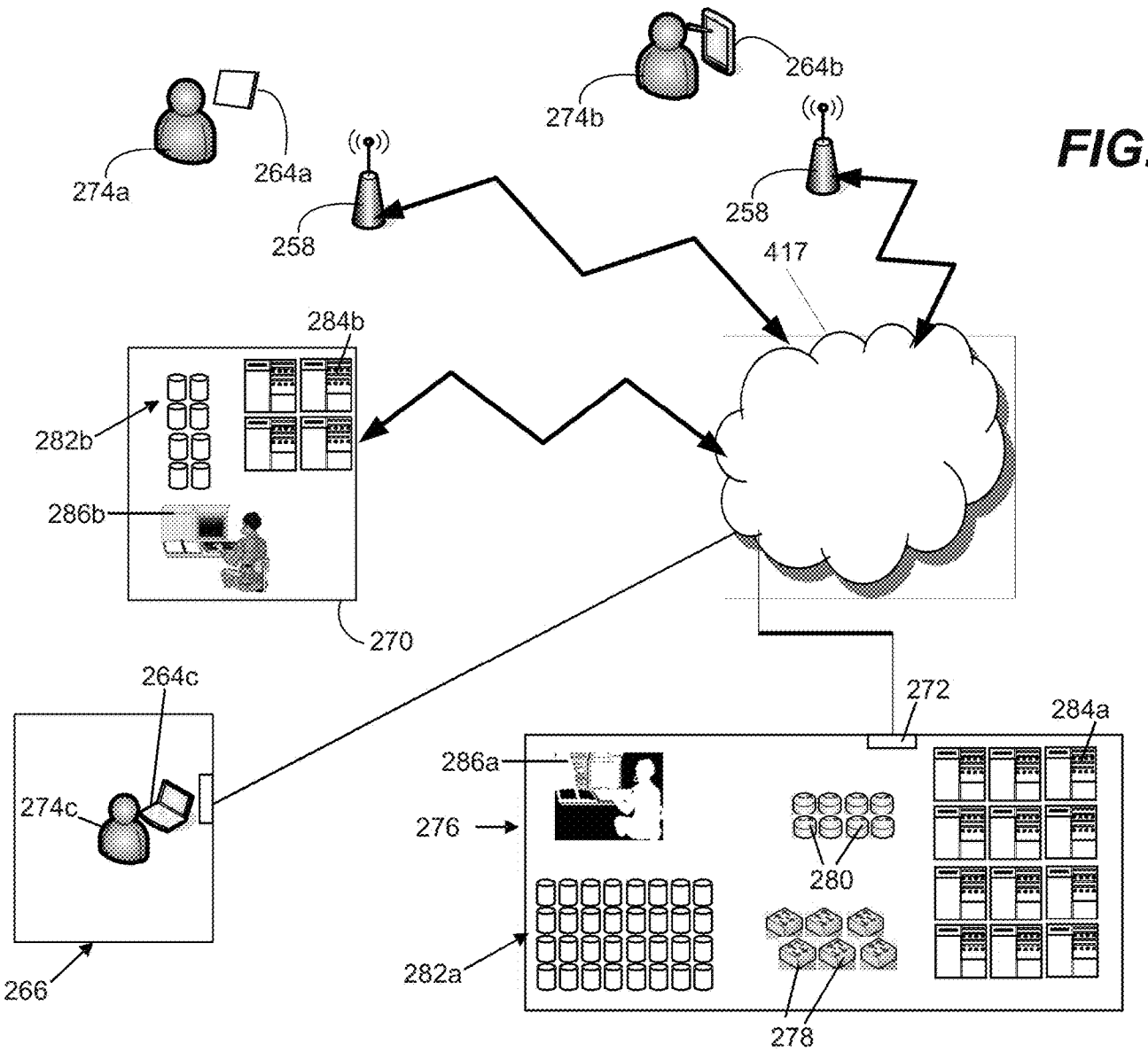
FIG. 2C is a diagram that shows examples of components of a system for providing online gaming according to some aspects of the present disclosure.

FIG. 2C is a diagram that shows examples of components of a system for providing online gaming according to some aspects of the present disclosure. As with other figures presented in this disclosure, the numbers, types and arrangements of gaming devices shown in FIG. 2C are merely shown by way of example. In this example, various gaming devices, including but not limited to end user devices (EUDs) 264*a*, 264*b* and 264*c* are capable of communication via one or more networks 417. The networks 417 may, for example, include one or more cellular telephone networks, the Internet, etc. In this example, the EUDs 264*a* and 264*b* are mobile devices: according to this example the EUD 264*a* is a tablet device and the EUD 264*b* is a smart phone. In this implementation, the EUD 264*c* is a laptop computer that is located within a residence 266 at the time depicted in FIG. 2C. Accordingly, in this example the hardware of EUDs is not specifically configured for online gaming, although each EUD is configured with software for online gaming. For example, each EUD may be configured with a web browser. Other implementations may include other types of EUD, some of which may be specifically configured for online gaming.

In this example, a gaming data center 276 includes various devices that are configured to provide online wagering games via the networks 417. The gaming data center 276 is capable of communication with the networks 417 via the gateway 272. In this example, switches 278 and routers 280 are configured to provide network connectivity for devices of the gaming data center 276, including storage devices 282*a*, servers 284*a* and one or more workstations 570*a*. The servers 284*a* may, for example, be configured to provide access to a library of games for online game play. In some examples, code for executing at least some of the games may initially be stored on one or more of the storage devices 282*a*. The code may be subsequently loaded onto a server 284*a* after selection by a player via an EUD and communication of that selection from the EUD via the networks 417. The server 284*a* onto which code for the selected game has been loaded may provide the game according to selections made by a player and indicated via the player's EUD. In other examples, code for executing at least some of the games may initially be stored on one or more of the servers 284*a*. Although only one gaming data center 276 is shown in FIG. 2C, some implementations may include multiple gaming data centers 276.

In this example, a financial institution data center 270 is also configured for communication via the networks 417. Here, the financial institution data center 270 includes servers 284*b*, storage devices 282*b*, and one or more workstations 286*b*. According to this example, the financial institution data center 270 is configured to maintain financial accounts, such as checking accounts, savings accounts, loan accounts, etc. In some implementations one or more of the authorized users 274*a*-274*c* may maintain at least one financial account with the financial institution that is serviced via the financial institution data center 270.

According to some implementations, the gaming data center 276 may be configured to provide online wagering games in which money may be won or lost. According to some such implementations, one or more of the servers 284*a* may be configured to monitor player credit balances, which may be expressed in game credits, in currency units, or in any other appropriate manner. In some implementations, the server(s) 284*a* may be configured to obtain financial credits from and/or provide financial credits to one or more financial institutions, according to a player's "cash in" selections, wagering game results and a player's "cash out" instructions. According to some such implementations, the server (s) 284*a* may be configured to electronically credit or debit the account of a player that is maintained by a financial institution, e.g., an account that is maintained via the financial institution data center 270. The server(s) 284*a* may, in some examples, be configured to maintain an audit record of such transactions.

In some alternative implementations, the gaming data center 276 may be configured to provide online wagering games for which credits may not be exchanged for cash or the equivalent. In some such examples, players may purchase game credits for online game play, but may not "cash out" for monetary credit after a gaming session. Moreover, although the financial institution data center 270 and the gaming data center 276 include their own servers and storage devices in this example, in some examples the financial institution data center 270 and/or the gaming data center 276 may use offsite "cloud-based" servers and/or storage devices. In some alternative examples, the financial institution data center 270 and/or the gaming data center 276 may rely entirely on cloud-based servers.

One or more types of devices in the gaming data center 276 (or elsewhere) may be capable of executing middleware, e.g., for data management and/or device communication. Authentication information, player tracking information, etc., including but not limited to information obtained by EUDs 264 and/or other information regarding authorized users of EUDs 264 (including but not limited to the authorized users 274*a*-274*c*), may be stored on storage devices 282 and/or servers 284. Other game-related information and/or software, such as information and/or software relating to leaderboards, players currently playing a game, game themes, game-related promotions, game competitions, etc., also may be stored on storage devices 282 and/or servers 284. In some implementations, some such game-related software may be available as "apps" and may be downloadable (e.g., from the gaming data center 276) by authorized users.

In some examples, authorized users and/or entities (such as representatives of gaming regulatory authorities) may obtain gaming-related information via the gaming data center 276. One or more other devices (such EUDs 264 or devices of the gaming data center 276) may act as intermediaries for such data feeds. Such devices may, for example, be capable of applying data filtering algorithms, executing data summary and/or analysis software, etc. In some implementations, data filtering, summary and/or analysis software may be available as "apps" and downloadable by authorized users.

Figure 3:
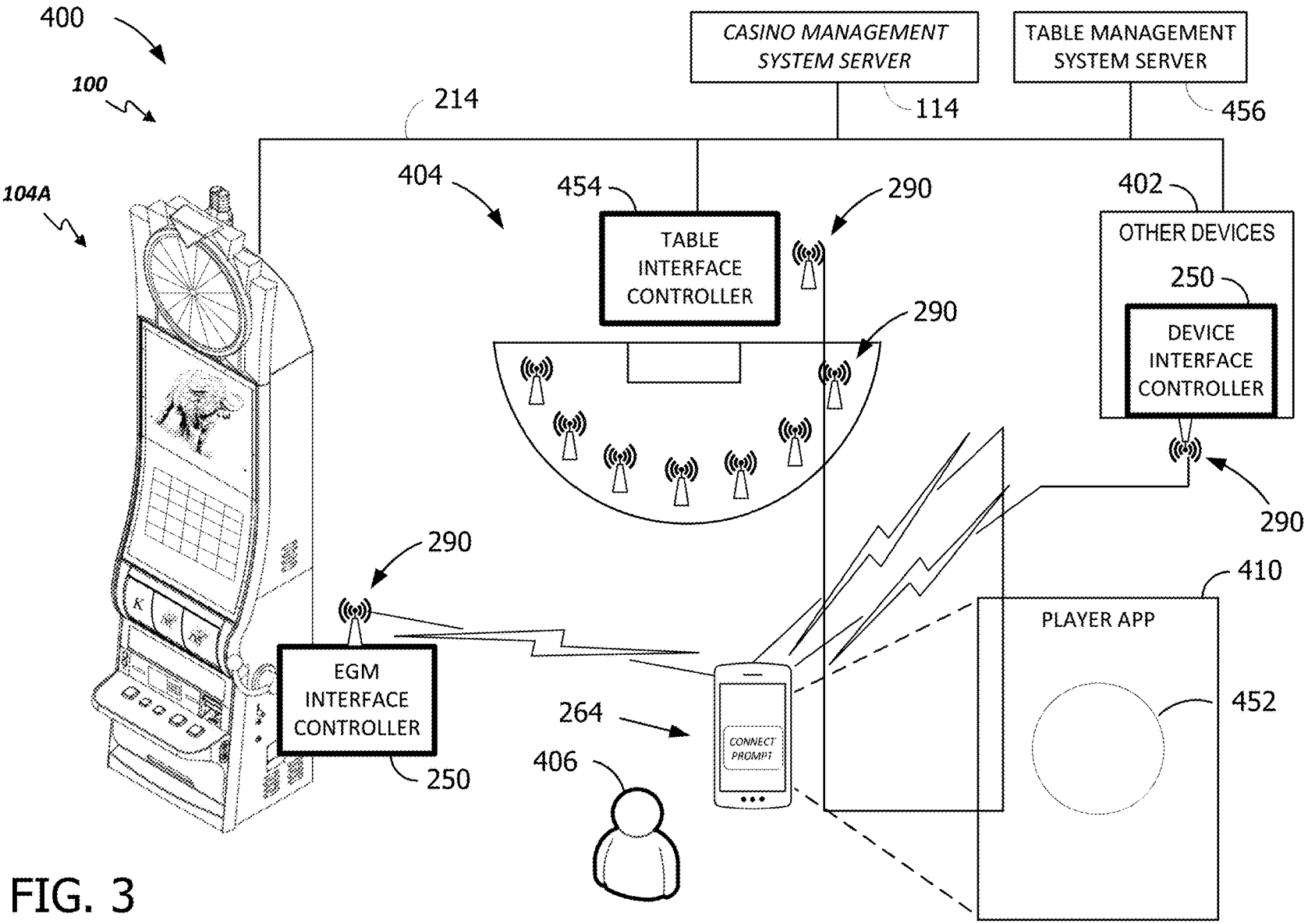
FIG. 3 is a diagram of various electronic devices on a casino property, each of which are enabled with wireless beacons and interface controllers that enable wireless communication between that particular device and end user devices of casino patrons.

FIG. 3 is a diagram of a cardless connection system 400 in which various electronic devices on a casino property are enabled with wireless beacons 290 and interface controllers 250 that enable wireless communication between that particular "target" device and mobile computing devices (e.g., EUD 264) of casino patrons (e.g., player 406). In the example embodiment, the casino has numerous electronic gaming devices 104 (e.g., slot machines, video slot or video poker machines, and so forth), smart tables 404, and may also have other wireless-enabled devices 402, such as TITO ticket exchange kiosks. For example, EGM 104A includes EGM interface controller 250 and beacon 290. Smart table 404 also includes one or more table interface controllers 250 and associated beacon(s) 290. Other electronic devices 402 within the casino property (e.g., kiosks, cashier stations at a cashier desk) may also include their own device controllers 250 and associated beacons 290.

In the example embodiment, each of the interface controllers 250 allows players at or near their respective underlying devices 104A, 402, 404 to wirelessly connect to those devices 104A, 402, 404, and may allow functionality or other connectivity to backend services provided on network 214. In some embodiments, beacons 290 may utilize a personal area network protocol, such as Bluetooth®, to connect to EUDs 264 of players. In some embodiments, beacons 290 may utilize near-field communications (NFC) for wireless connectivity with EUDs 264, perhaps including a designated area on EGM 104 (e.g. on a designated area of a button deck or virtual button deck) within which the player places their EUD 264 to facilitate connectivity. Such connectivity may be used, for example, to establish player identity at device 104A, 402, 404 (e.g., loyalty identification of the player 406, or "carding in" to the device), perform digital wallet transactions with the device 104A, 402, 404, establish player location of player 406, track game play data of player 406 (e.g., for a loyalty system), or establish and maintain "tethering" between player 406 and the connected device (e.g., to verify continued presence of the player 406 for maintaining a gaming session). Further, beacons 290 may be physically or wirelessly connected to a local area network, such as a public network (e.g., local Wi-Fi network) or a private network (e.g., network 214) to facilitate connectivity to various servers 102.

In the example embodiment, player 406 installs a player app 410 on their EUD 264. To establish cardless connection with a nearby device, in the example embodiment, when in standby mode (e.g., when not connected to a EUD 264), each of beacons 290 is configured to operate as a stateless device advertising no beacon identifier or, in some embodiments, an idle or default beacon identifier. Further, beacons 290 are also configured to reprogram their beacon ID, thus allowing beacons 290 to be configured with custom beacon IDs. In some embodiments, beacons 290 are configured to transmit a beacon/custom payload in addition to and/or including the beacon ID (e.g., as described in further detail in U.S. patent application Ser. No. 17/211,521, filed Mar. 24, 2021, which is hereby incorporated by reference in its entirety). In some embodiments, beacons are configured to reprogram their beacon payload (e.g., upon receiving a beacon payload reconfiguration instruction from a server). In some embodiments a beacon may transmit a beacon ID and a beacon payload to EUD 264. In some embodiments, a beacon may transmit an idle (default) beacon ID and an idle (default) payload to EUD 264. In some embodiments, the beacon may transmit a custom ID and a custom payload to EUD 264. Combinations of idle and/or custom beacon ID and payload transmissions to EUD 264 are possible (e.g., the custom beacon ID may include additional data as described below, for example, with respect to marketing/advertising data). In some embodiments, once EUD 264 is connected (e.g., to server 114), beacon 290 may revert back to transmitting the idle beacon identifier (e.g., the custom beacon ID is available to EUD 264 during the connection process to EUD 264 and/or other designated time periods). Casino management system server 114, table management system server 456, or other server 102, manages aspects of connectivity between devices 104A, 402, 404 and EUDs 264 of patrons. More specifically, casino management system server 114 acts as a centralized manager of connection requests, providing beacon IDs to the beacons 290 during connection setup.

During operation, player 406 may initiate a connectivity request (e.g., an inquiry scan) to connect with the target device (e.g., EGM 104, table 404, other device 402) from their EUD 264. For example, player 406 may select a connection prompt button in player app 410 to begin connecting with the target device. Beacon 290 of the target device, at this time, has no beacon ID or has an idle beacon ID. However, beacon 290 does detect the connectivity request from EUD 264 (e.g., via EGM 104A receiving the connect request from CMS server 114). Upon detection of the connectivity request, interface controller 250 of the target device transmits a beacon ID request to CMS server 114. CMS server 114 generates a custom beacon ID for beacon 290 (e.g., randomly, uniquely) and associates that custom beacon ID both with the target device (e.g., a unique device identifier for EGM 104A, smart table 404, or other device 402) as well as with the particular EUD 264 of player 406 (e.g., based on a unique device identifier of EUD 264). EUD 264 of player 406 may also be identified and authenticated by CMS server 114, such as comparing the device ID of the requesting EUD 264 with a stored device ID database, or via player credentials, such as a player app ID, loyalty ID and associated password or other authentication method (e.g., biometric, facial recognition, or such). Upon successful authentication, CMS server 114 transmits a custom beacon ID to the requesting target device.

Interface controller 250 receives the custom beacon ID and configures beacon 290 with the custom beacon ID. The custom beacon ID is then used to connect EUD 264 of player 406 with the target device (e.g., as a unique device identifier for EGM 104A, smart table 404, or other device 402). In some embodiments, player 406 is then prompted to enter their login credentials, which allows the target device and CMS server 114 to authenticate the player (e.g., at an application level authentication). In some embodiments, CMS server 114 may associate the requesting EUD 264 with the login ID of player 406. In the example embodiment, server 114 establishes a secure connection between EUD 264 and the target device and can commence session communication. In some embodiments, interface controller 250 (e.g., instead of server 114) may establish a secure connection between EUD 264 and the target device and can commence session communication.

In the example embodiment, once connected, the target device may provide various services directly to EUD 264 (e.g., via the custom payload described herein). For example, the connectivity may allow the target device to transmit messages to EUD 264 including indications of credit amounts, point amounts, comps, hard currency amounts, and/or other marketing/advertising data (e.g., via the custom payload and/or custom beacon ID may include data regarding the above examples and other examples described herein). For example, the marketing/advertising data transmitted from the target device to EUD 264 may be specific to the target device and/or one or more electronic games played on the target device. The connectivity (e.g., from the target device to EUD 264, from EUD 264 to server 114, and from server 114 to the target device) may allow the player to establish a social or wagering gaming session, enter into a sports wagering session, or a virtual gaming session. The connectivity may allow the player to reserve the target device or pause their gaming session to be resumed later (e.g., maintaining state while they step away from the EGM 104A to eat or use the restroom). The connectivity may allow devices 104A, 402, 404 to provide a personalized device experience through, for example, settings, game type selections, game theme selections, or monetary preferences associated with the player. The connectivity may allow the player to enter into social group communications, enter into communitive gaming sessions, or enter into remote wagering sessions. In some embodiments, the target device may provide a communications gateway through to various services provided on backend network 214.

In the example embodiment, while EUD 264 of player 406 is connected to an EGM (e.g., indirectly via server 114, or any other server described herein), player 406 can play any game offered by EGM 104A without physically contacting EGM 104A. In the example embodiment, communication from EUD 264 to the target device (e.g., EGM 104A) is facilitated by server 114 (e.g., see FIG. 7 connected actions 680). In some embodiments, communication from EUD 264 to the target device may be directly from EUD 264 to the target device without the use of a backend server.

As examples, player 406 is able to transfer funds, select a game to play, select a wager amount, select a number of paylines, and/or interact with any buttons (e.g., button deck 120) provided on EGM 104A via EUD 264. For example, after placing a wager via EUD 264, a button 452 may be displayed on EUD 264 (e.g., a spin button). Upon player selection of button 452, as a slot game example, a plurality of reels may spin on EGM 104A as would occur if player 406 had selected a button on EGM 104A itself. Further, continuing the slot example, after the spin of the plurality of reels has stopped, a game outcome, and any awards associated therewith, may be displayed on a display of EGM 104A and/or EUD 264. In some embodiments, a plurality of buttons is displayed on EUD 264 (e.g., some or all buttons 122 on button deck 120 are displayed as virtual buttons on EUD 264). Player 406 can then interact with the display of EUD 264 to play a game on EGM 104A without having to touch EGM 104A. In some embodiments buttons displayed on EUD 264 are different than buttons on button deck 120, but provide similar button inputs (e.g. a wager amount up and a wager amount down button may be displayed on EUD 264, that provide similar button input as, e.g. five individual wager amount buttons on button deck 120). Notably, all components player 406 can interact with on EGM 104A are displayed on EUD 264 such that player 406 still has access to the functionalities offered by U/I components of EGM 104A, but through EUD 264 as opposed to physically touching EGM 104A itself.

While player 406 continues to be in the session with the target device, beacon 290 does not accept new connections and, in some embodiments, may discontinue transmitting the custom beacon ID (e.g., either transmitting no beacon ID or an idle beacon ID). As such, another player attempting to connect to interface controller 250 of the target device will not detect beacon 290, and thus cannot connect to the target device until the existing connection is cancelled. In some embodiments, if another player attempts to connect to the target device while the previous connected session is still active, beacon 290 may cancel that previous connected connection and return to the standby state (e.g., without a beacon ID). For example, the original connected player may move to another EGM near original EGM 104A, but perhaps not far enough away to lose connectivity on the original connection. When another player attempts to connect EGM 104A, beacon 290 terminates the original connection and returns to the standby state, which then allows beacon 290 to request a new custom beacon ID that can be used to connect with the new player's device. As such, stale connections may be terminated by this process, which causes beacon 290 to acquire a new custom beacon ID for the next connection.

In some embodiments, EUD 264 may detect a disconnection of EUD 264 from beacon 290 (e.g., player 406 walks too far away from beacon 290, player 406 causes disconnection via the player app, a dealer or EGM 104 disconnects player 406, beacon 290 loses power, or such). Upon disconnection, EUD 264 transmits a disconnecting message to CMS server 114 indicating a disconnecting of the player 406 (e.g., their EUD 264) from the target device. CMS server 114 may disconnect EUD 264 from the target device and may reconfigure beacon 290 to transmit a default ID. The CMS server 106 may update a record of player positioning (e.g., within the table management database 1320) to virtually remove the player 406 from the target device based on the disconnecting.

When EUD 264 of the player disconnects with EGM 104A, beacon 290 returns to a standby state and advertises no beacon ID or an idle beacon ID. When another player attempts to connect with EGM 104A, beacon 290 again requests a new custom beacon ID for connecting with that new player's device. As such, beacons 290 of each of devices 104A, 402, 404 effectively implement changing beacon IDs, which are provided on demand and at the time of the connectivity attempt by CMS server 114.

Figure 4:
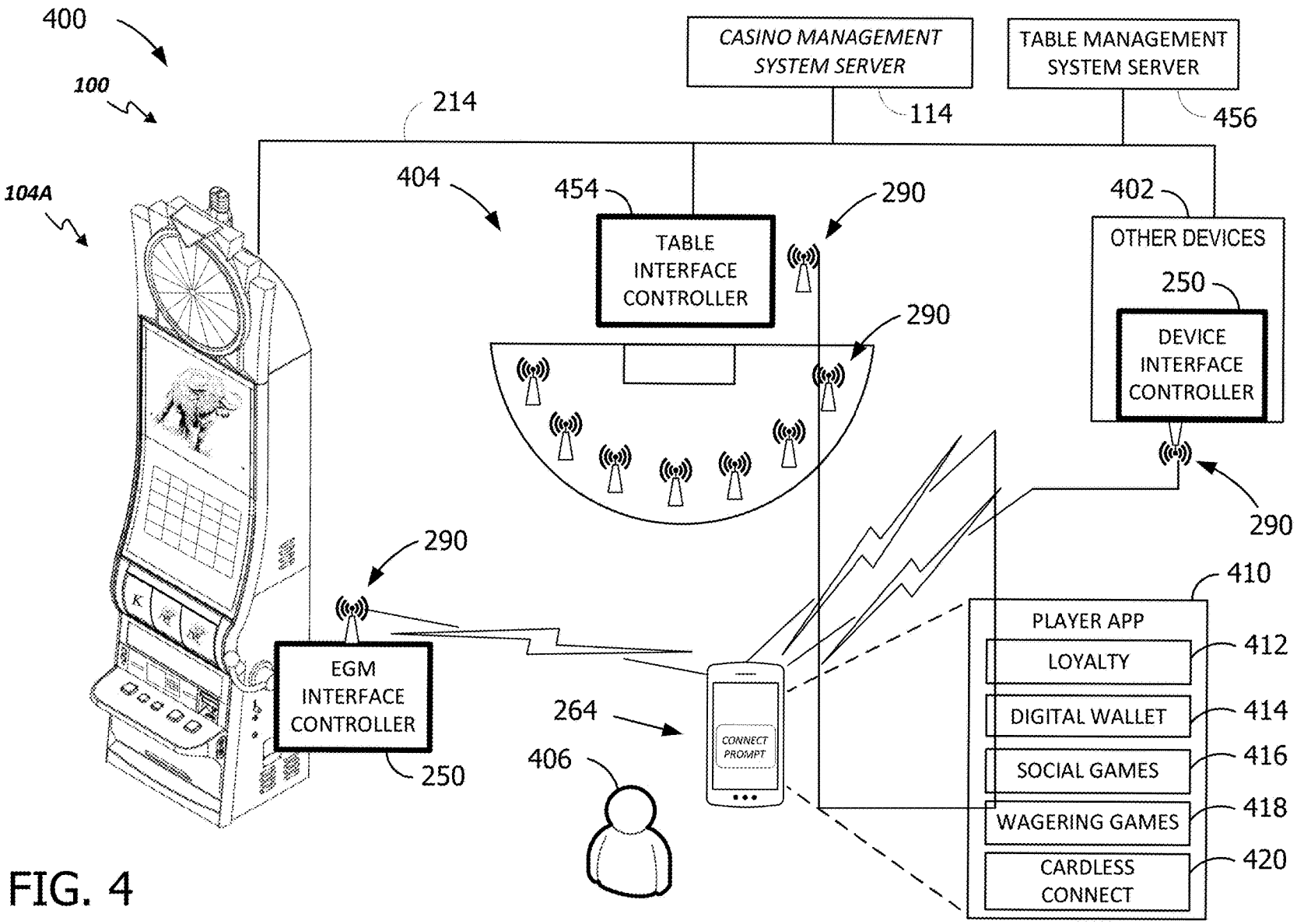
FIG. 4 is another diagram of various electronic devices on a casino property, each of which are enabled with wireless beacons and interface controllers that enable wireless communication between that particular device and end user devices of casino patrons.

FIG. 4 is another diagram of a cardless connection system 400 in which various electronic devices on a casino property are enabled with wireless beacons 290 and interface controllers 250 that enable wireless communication between that particular "target" device and mobile computing devices (e.g., EUD 264) of casino patrons (e.g., player 406). In this example, the player app 410 may provide a loyalty component 412, a digital wallet component 414, a social games component 416, a wagering games component 418, a cardless connection component 420 and an EGM user interface component. For example, player app 410 may be used to establish cardless connection with gaming machines 104, smart tables 404, or other devices 402 through the cardless connection component 420, to perform digital wallet transactions (e.g., cash-in, cash-out), or to enter into rated session play under their loyalty ID. The social games component 416 provides various social games that may be played by player 406 on EUD 264 (e.g., using virtual currencies, or other non-wagering game play). Wagering games component 418 provides various wagering games that may be played by player 406 on EUD 264 (e.g., using various real currencies via their digital wallet or other player accounts). Wagering games may require player 406 to be within at a physical venue of an operator, which may be determined and verified by GPS location data of EUD 264 and geofencing. Player app 410 EGM user interface component provides a user interface (UI) for EGM 104 to allow the player to provide game play inputs (e.g. game play button inputs) to EGM 104 via a touchscreen of EUD 264. Communication between EUD 264 and EGM 104 may be via a casino network server (e.g., CMS server 114), or directly to EGM 104 via NFC or another wireless interface (e.g., Bluetooth, ultrasonic, optical, etc.). In some embodiments the EGM user interface component may receive configuration instructions (e.g., to configure the EGM UI button options and layout on the EUD 264), via the beacon custom payload. In some embodiments, the configurations may be received via a casino network server (e.g., CMS server 114).

Figure 5:
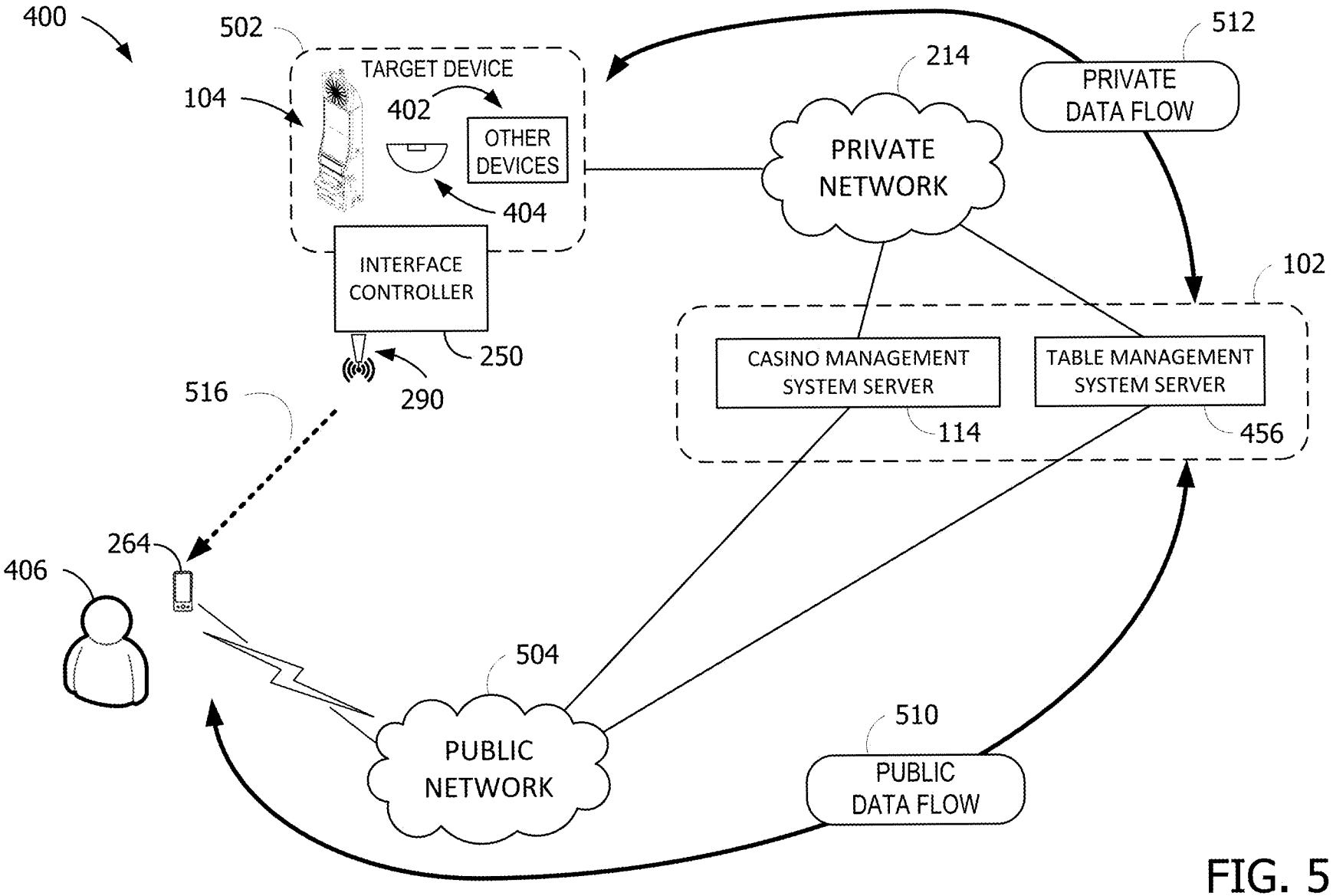
FIG. 5 is an example networked environment depicting aspects of connectivity and data flow between an end user device and a target device within the cardless connection system.

FIG. 5 is an example networked environment 500 depicting aspects of connectivity and data flow between mobile EUD 264 and target device 502 within cardless connection system 400. Target device 502 may be EGM 104, smart table 404, or one of the other devices 402, having interface controller 250 and wireless beacon 290 (e.g., Bluetooth beacon) as described above. In the example embodiment, player app 410 may interact with the cardless connection system 400 for various purposes, such as cardless connection (e.g., "carding in" to establish loyalty identity at EGMs 104 or smart tables 404), digital wallet interaction (e.g., cashing into or out of EGMs 104 or smart tables 404, performing transactions, redeeming stored rewards, or such), interacting with a loyalty system, or various other functions. However, the data flow for such interactions between EUD 264, servers 102, and target devices 502 are restricted by cardless connection system 400. Data transmitted between EUD 264 and servers 102 or target devices 502 of the example networked environment may be passed from EUD 264 across a public network 504, and possibly a private network 214, to servers 102 (e.g., represented in bolded line as public data flow 510) and from servers 102 across the private network to and from target device 502 (e.g., represented in bolded line as private data flow 512).

Data sent from servers 102 and/or device 502 to the EUD 264, and vice versa, may be low bandwidth (e.g., placing a low data load on an existing network) in order to ensure reliable communication between devices. For example, the data sent could be a single packet constructed with a network communication header and/or footer (e.g., Ethernet header, sender and/or recipient IP addresses, protocol format of the ID and/or payload, etc.), EGM device information, I/O command, and other button data. In some embodiments, the button data could be one bit long for each button (e.g., one bit is designated for each button on the EGM and/or displayed on the EUD). The player is then able to play at least one game provided by device 502 through EUD 264, and does not need to touch device 502 at all. For example, a player may be able to transfer funds from a player account via EUD 264 to device 502 for play of a game thereon. A player may receive any award presented by device 502 at EUD 264. During play of a game, any user interface provided by device 502 may be displayed on EUD 264 (e.g., a button, a button deck, pay line options, wager amount options, etc.). Accordingly, the player never needs to come in contact with device 502, and instead only needs to contact a trusted EUD 264

In other words, each transmission (e.g., from beacon 290 to EUD 264 and/or from EUD 264 to the server) may include a message header and a message payload. In some embodiments, the message header includes a 2-byte message type indicator (e.g., a code identifying the message as a switch status communication), and the message payload includes a 2-byte custom (machine) ID (e.g., a code identifying target device 502, as received from beacon 290), a 2-byte switch panel layout code (e.g., defining a switch panel configuration), and 2-bytes containing the switch status data. The message header or message payload may include fewer, greater, and/or alternative data fields that facilitate the embodiments described herein (e.g., resulting in fewer/greater bytes, such as 1 byte).

System 400 provides for low-bandwidth communications not only from beacon 290 to EUD 264, but also from EUD 264 to server(s) 102. For example, once EUD 264 is connected to at least one of servers 102, messages from EUD 264 to server(s) 102 may include only one bit dedicated to each button displayed on EUD 264 (e.g., virtual buttons displayed on a virtual button deck on EUD 264). For example, one bit of a low-bandwidth message may be dedicated to a bet up button, one bit may be dedicated to a bet down button, one bit may be dedicated to a spin button, one bit may be dedicated to a cash out button, etc. Accordingly, in addition to the low-bandwidth, one-way communications from beacon 290 to EUD 264 as described herein, low-bandwidth communications are also envisioned as being transmitted from EUD 264 to server(s) 102 (e.g., and then from server(s) to device 502), thereby causing the messages to be transmitted more quickly and efficiently than other messages that may be being transmitted across networks 504, 214, etc.

In various embodiments described herein, player 406 establishes wireless connectivity between EUD 264 and target device 502 via beacon 290. In some embodiments, target device 502 may allow unidirectional transmission data across connection 516, allowing data to be sent out from beacon 290 (e.g., via the beacon idle or custom payload). In some embodiments, target device 502 may allow bidirectional transmission data across connection 516, allowing data to be sent out from and received at beacon 290.

Various embodiments are envisioned for low-bandwidth messages transmitted from beacon 290 to EUD 264 and from EUD 264 to server 114 (e.g., and/or any other server in communication with EUD 264). For example, target device 502 can request and obtain a custom ID and/or payload from server 114. The custom payload (e.g., including the custom ID) can be transmitted to device 502 and then transmitted on a one-way Bluetooth® beacon message from beacon 290 to EUD 264. Receipt of the payload can cause an appropriate button deck to be displayed on EUD 264. For example, a mobile app on EUD 264 may store a number of button decks for display at different times depending on the target device EUD 264 is connected to. As an example, custom payload from beacon 290 to EUD 264 may include one or more bits and/or bytes dedicated to indicating which button deck should be displayed at EUD 264. For example, if two bits (e.g., any number of bits and/or bytes of the custom payload may be dedicated to identifying a button deck and/or other information to be displayed at EUD 264) of the custom payload are dedicated to a button deck configuration, beacon 290 may be configured by device 502 to transmit 00 when a first button deck is to be displayed, 01 when a second button deck is to be displayed, 10 when a third button deck is to be displayed, and 11 when a fourth button deck is to be displayed. Upon receipt of the custom payload, EUD 264 analyzes the two bits of the custom payload dedicated to the button deck configuration, and causes display of an appropriate button deck at EUD 264 in response to analyzing the two bits of the message. Various configurations of bits and/or bytes are envisioned for the low bandwidth communications from beacon 290 to EUD 264 described herein (e.g., the custom payload may include an indication of a current credit balance at device 502, an indication of a theme of a game at device 502, etc.).

The custom payload can be packaged with the custom ID, other custom data, and transmitted as a Bluetooth® beacon message to EUD 264. Receipt of the message at EUD 264 can cause buttons, meters, and/or other data/animations to be displayed on EUD 264 by a casino app on EUD 264. The custom identifier and/or the custom payload can be transmitted for a predetermined period of time, such as in a range from 10 s to 10 minutes ("min"), from 30 s to 3 min, or about one minute.

In some embodiments, EUD 264 and device 502 can be determined to be near one another if EUD 264 is within a predetermined threshold distance from device 502. The detection can be based on any one or more of various messages, such as a custom payload received over the wireless one-way channel at EUD 264, or a received signal strength indicator ("RSSI") of such signal. The RSSI can be compared with a transmitted signal strength encoded in the custom payload to determine a distance from beacon 290. The comparison and determination of distance can be performed on EUD 264, or by server 114 based on information relayed by EUD 264. The detection can be based on determining a location of EUD 264, for example by triangulation or trilateration. The triangulation or trilateration can be based on signals (commonly, three or more) received at EUD 264 or received from EUD 264, in any combination. The triangulation or trilateration can be performed on EUD 264, or can be performed at one or more other computing devices that are part of or coupled to server 114. In further examples, the detection can be performed by acoustic or optical ranging, such as with one or more cameras mounted at gaming device 502. That is, the first indication can be received at device 502 directly from EUD 264 (e.g. in the form of illumination directed from EUD 264 to be imaged at a camera associated with device 502). In some embodiments, the threshold region can extend to a maximum of 1 m, 3 m, 5 m, or 10 m from gaming device 415.

Figure 6:
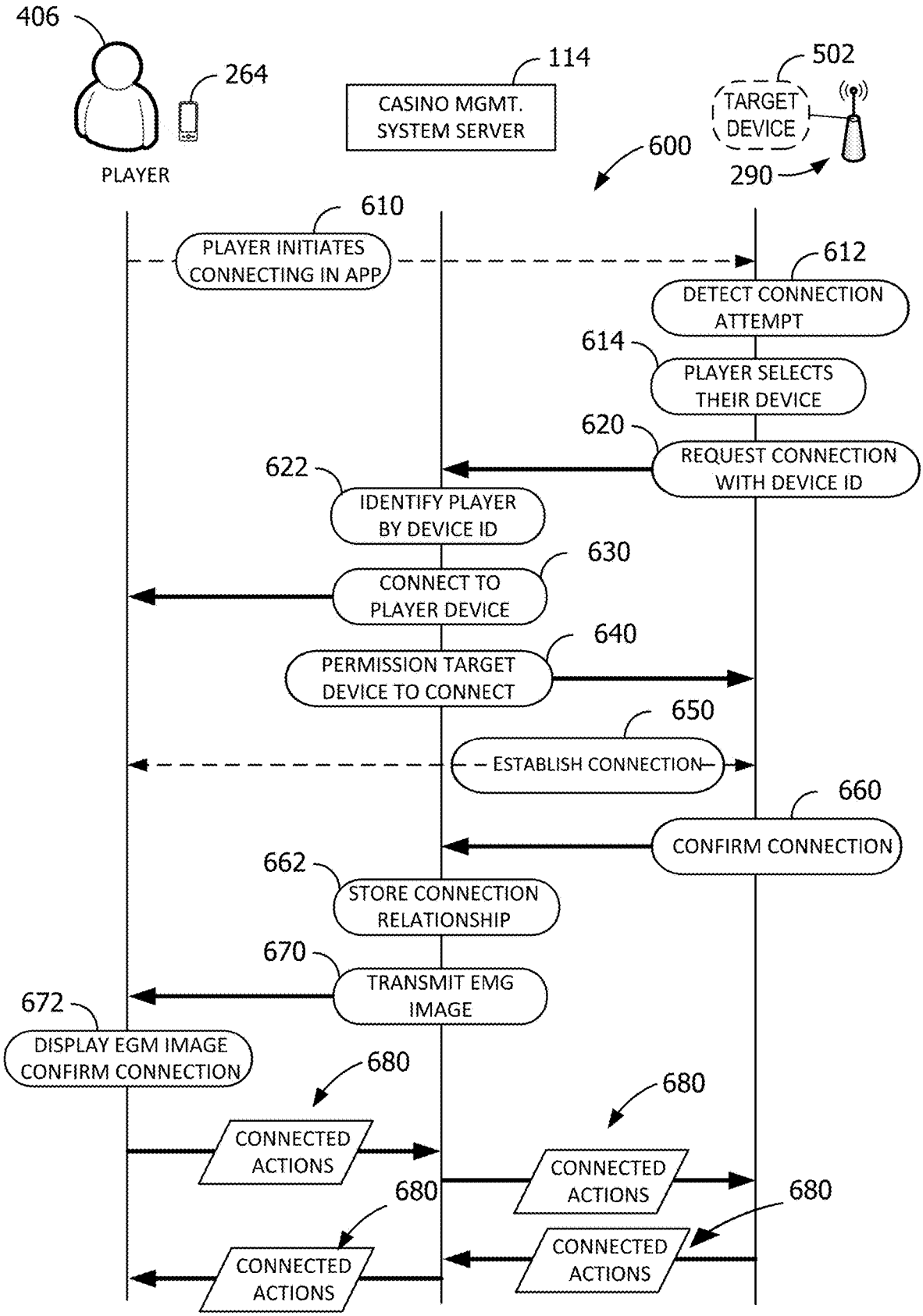
FIG. 6 is a data flow diagram illustrating one example connection process between the end user device of a player, the casino management system server (or other server), and the target device.

FIG. 6 is a data flow diagram illustrating one example connection process 600 between the EUD 264 of the player 406, the casino management system server 114 (or other server 102), and the target device 502. In the example shown here, connectivity across the connection 516 (e.g., between the target device 502 and the EUD 264) is illustrated in broken line and connectivity across public network 504 and private network 214 (e.g., between the EUD 264 and the casino management system server 114, or between the casino management system server 114 and the target device 502) is illustrated in heavy line. In the example embodiment, the target device 502 includes a beacon 290 for wireless connectivity to the EUD 264 of the player, as well as a display device (e.g., game displays 240, 242, or such) that allows the player 406 to view digital content displayed by the target device 502. Further in the example embodiment, beacon 290 emits a custom beacon ID as received from a server (e.g., casino management server 114) that can be received by EUD 264. However, beacon 290 receives no data from EUD 264. Rather, data from EUD 264 is transmitted either directly to target device 502 (e.g., via NFC, Bluetooth, ultrasonic, optical, etc.) or transmitted to target device 502 via a server (e.g., servers 102).

In the example embodiment, process 600 begins when player 406 positions EUD 264 within range of beacon 290 of target device 502 and player 406 initiates a connecting attempt within player app 410 (e.g., via the cardless connect component 420). For example, player 406 may be standing in front of EGM 104 when they begin the connecting process. Upon connecting initiation, at operation 610, EUD 264 begins broadcasting its own device ID ("wireless device ID", e.g., Bluetooth device name, unique address, or such). Target device 502 automatically scans for and detects the nearby device and receives the device ID of EUD 264 from the broadcast. In some embodiments, player 406 may need to prompt target device 502 to scan for nearby devices (e.g., via options on the display of the target device 502). At operation 612, target device 502 displays device IDs of nearby devices and allows the player to select their own device from the list. At operation 614, player 406 identifies and selects their own device on the display of target device 502 (e.g., based on knowledge of their own device ID).

Upon device selection, in the example embodiment, the target device 502 then transmits a connecting request message to the casino management system server 114 at operation 620. The connecting request message includes selected device ID of the EUD 264 and a device identifier of the target device ("target device ID", e.g., uniquely identifying target device 502 from other devices managed by casino management system server 114). At operation 622, casino management system server 114 receives the connecting request message and identifies player 406 based on their device ID. In the example embodiment, casino management system server 114 maintains a list of known device IDs and associated player information. For example, during installation or registration of player app 410 onto EUD 264, player 406 may register EUD 264 with casino management system server 114, providing their wireless device ID and other player profile information (e.g., loyalty ID, player name, physical device ID, mobile phone number, network address, and such). As such, if casino management system server 114 is able to identify player 406 and EUD 264 based on the selected device ID, casino management system server 114 attempts to connect with player EUD 264 at operation 630 (e.g., over public network 504). In some embodiments, player 406 may be prompted to confirm the connecting attempt on EUD 264 (e.g., to ensure someone else is not attempting an unauthorized connecting attempt). In some embodiments, player EUD 264 may set an internal state to "attempting connecting" at operation 610 and, upon receiving connection attempt at operation 630, may automatically transmit an acknowledgment that EUD 264 is currently attempting a connection. In some embodiments, player 406 may be prompted to provide, or the EUD 264 may automatically provide, authentication credentials (e.g., username, password, biometric, or other personal authentication data).

In the example embodiment, if EUD 264 of the player 406 is confirmed to be attempting to connect, then casino management system server 114 transmits a connecting authorization message to target device 502 at operation 640. The connecting authorization message or a subsequent message may include additional information about the connection, such as additional device information of EUD 264 or additional player information about player 406. At operation 650, upon receipt of the connecting authorization message, the target device 502 establishes connection with EUD 264. In some embodiments, establishing connection may also require a confirmation on the EUD 264 (e.g., by a prompt within player app 410). Once connection has been confirmed between EUD 264 and target device 502, target device 502 transmits a connecting confirmation message to casino management system server 114 at operation 660. In some embodiments, EUD 264 may additionally or alternatively transmit a connecting confirmation message to the casino management system server 114. At operation 662, casino management system server 114 stores a record of the active connection (e.g., in a database). The connection record may include device information of EUD 264, player information of player 406, or device information of target device 502. In some embodiments, upon confirmation of the connection, casino management system server 114 may transmit an image of or otherwise associated with target device 502 to EUD 264, and EUD 264 (e.g., the player app 410) may display the image of target device 502 to provide additional confirmation to player 406 that connection has been successful and a visual indicator of target device 502 (e.g., for player assurance).

Once connection has been established, in some embodiments, no application layer data is transmitted directly from EUD 264 to target device 502 (e.g., over connection 516). In some embodiments, application layer data may even be prohibited directly from target device 502 to EUD 264. Rather, any actions that involve EUD 264 and target device 502 (e.g., "connected actions" 680) are instead performed through casino management system server 114 or other server 102 (e.g., over private network 214 or public network 504). For example, a digital wallet request to transfer cash into target device 502 for $100 from a play account in the digital wallet may be initiated from player app 410 and sent to casino management system server 114 for processing. When the transaction is otherwise verified and authorized, casino management system server 114 may transmit an instruction to credit target device 502 with $100 in credits to conclude the transaction. As such, EUD 264 does not perform such communications directly to target device 502.

In some embodiments, the target device 502 or the EUD 264 may perform monitoring activities or communications over the connection 516 while the connection remains established. For example, target device 502 may periodically send ping or other status requests to EUD 264 to ensure that the connection is still established (e.g., to ensure that devices 264, 402 are still within range, powered on, communicating with each other, and such). If target device 502 detects a loss of connection with EUD 264, or vice versa, target device 502 may transmit a disconnection message to casino management system server 114, causing the connection record to be updated as disconnected or deleted from the database.

Figure 7:
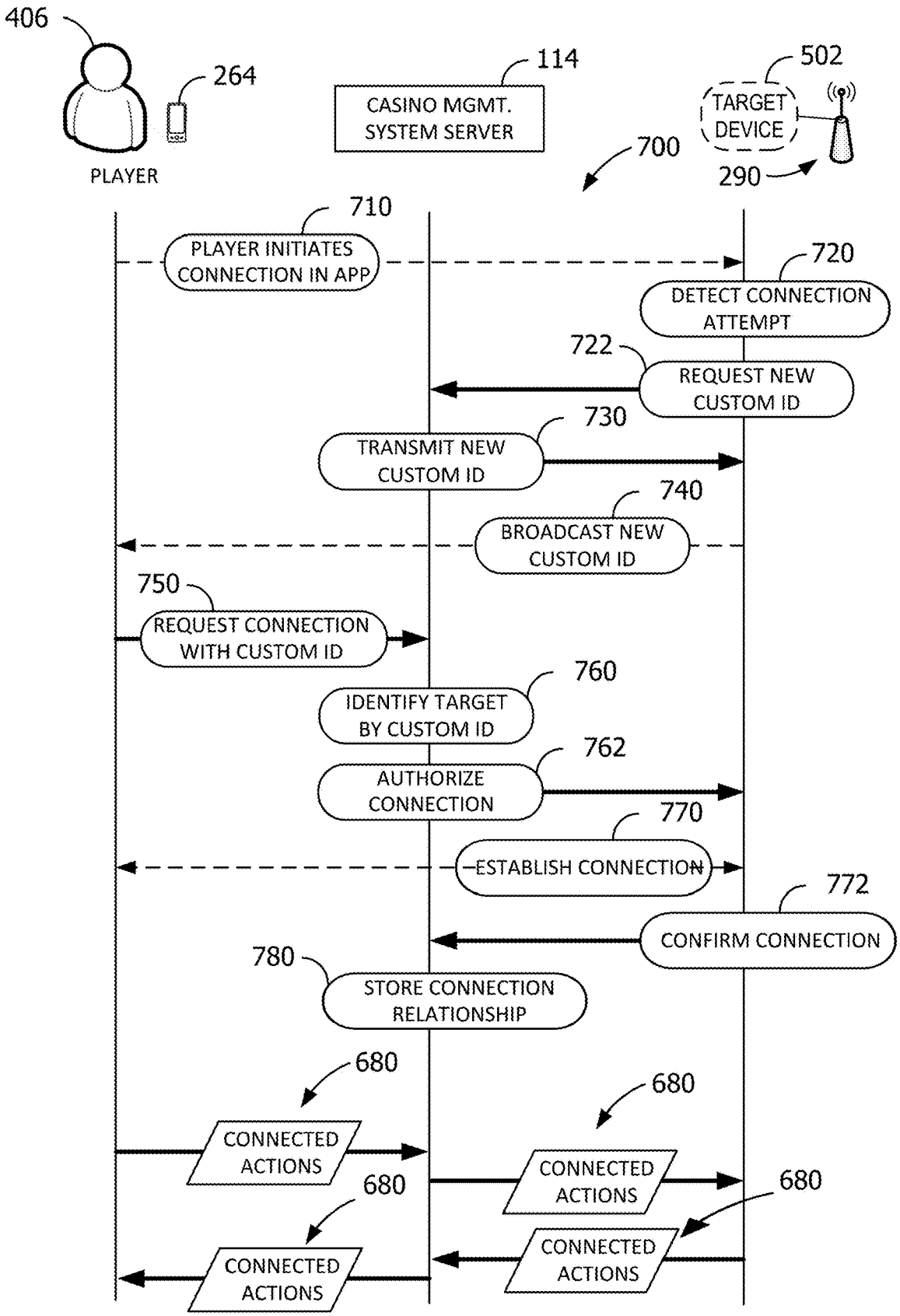
FIG. 7 is a data flow diagram illustrating another example connection process between the end user device of a player, the casino management system server (or other server 102), and the target device.

FIG. 7 is a data flow diagram illustrating another example connection process 700 between EUD 264 of player 406, casino management system server 114 (or other server 102), and target device 502. In the example embodiment, process 700 provides dynamic beacon IDs for beacon 290 of target device 502 and may not require player interaction with target device 502 to complete connecting. In the example shown here, connectivity across connection 516 (e.g., between target device 502 and EUD 264) is illustrated in broken line and connectivity across public network 504 and private network 214 (e.g., between EUD 264 and casino management system server 114, or between casino management system server 114 and target device 502) is illustrated in heavy line. In the example embodiment, the target device 502 includes a beacon 290 for wireless connectivity to the EUD 264 of the player. As explained above, in the example embodiment, beacon 290 is a transmit only device and receives no data from EUD 264. Rather, data from EUD 264 is transmitted either directly to target device 502 (e.g., via NFC, Bluetooth, ultrasonic, optical, etc.), transmitted to target device 502 via a server (e.g., servers 102), or transmitted to a server directly and not transmitted to target device 502.

In the example embodiment, process 700 begins when player 406 positions EUD 264 within range of beacon 290 of target device 502 and player 406 initiates a connecting attempt within player app 410 (e.g., via cardless connect component 420). For example, player 406 may be standing in front of EGM 104 when they begin the connecting process. In another embodiment, process 700 begins when player 406 positions EUD 264 upon button deck 120 (e.g., virtual button deck) and EUD 264 is detected by EGM 104. In some embodiments EUD 264 may be placed upon a wireless charging station provided within button deck 120 or another predetermined location on button deck 120. In some embodiments EGM 104 may detect EUD 264 when EGM 104 detects a device charging on the wireless charging station. In some embodiments button deck 120 may contain a wireless communication device (e.g., NFC, Bluetooth, ultrasonic, optical, etc.) providing a wireless communication interface from EUD 264 to EGM 104. In some embodiments, EGM 104 may detect EUD 264 when EUD 264 is placed on button deck 120 and player app 410 (e.g., via player app 410 user interface component) attempts to connect with EGM 104 via the wireless communication interface (e.g., via the wireless communication device). Upon connection initiation, at operation 710, EUD 264 begins broadcasting its own device ID ("wireless device ID", e.g., Bluetooth device name, unique address, or such). In the example embodiment, target device 502 automatically scans for and detects the nearby device, at operation 720, and receives the device ID of the EUD 264 from the broadcast. In some embodiments, player 406 may need to prompt target device 502 to scan for nearby devices (e.g., via options on the display of target device 502). In some embodiments, in lieu of operation 720, player 406 may manually cause target device 502 to request a new custom ID by, for example, selecting a button on primary display device 240 of target device 502. In some embodiments, target device 502 may not scan for or detect nearby devices. For example, within operation 710, target device 502 may transmit a beacon ID (e.g., an idle or custom beacon ID) which is detected by player app 410 on EUD 264 and communicated to casino management system server 114. In such embodiments, player 406 may press a button on target device 502 (e.g., a "Connect" button) to begin the request for the custom beacon ID of operation 722 or EGM 104 may begin the request for the custom beacon ID upon detection of EUD 264, as discussed above At operation 722, target device 502 transmits a beacon ID request to casino management system server 114, requesting a new custom beacon ID (or just "custom ID"). The custom ID request may include a unique device identifier for beacon 290 ("beacon device ID") or target device 502. Casino management system server 114 or other server 102 may store device identifiers for various beacons 290 that are managed, and may associated each of the unique beacon device IDs with particular target devices 502, thereby allowing casino management system server 114 to uniquely identify with which target device 502 the request is associated (e.g., via association between unique device ID, smart table ID, and position ID at that smart table). Beacon 290 is configured to allow a dynamic reconfiguration of the beacon ID, allowing beacon 290 to change IDs during operation (e.g., to facilitate secure connections). At operation 730, casino management system server 114 generates a new custom ID (e.g., based on an output of RNG 212), stores an association of that new custom ID with target device 502, and transmits that new custom ID to target device 502. In some embodiments, the new custom ID is generated to be unique amongst a pool of wireless beacon devices (e.g., multiple beacons 290) managed by casino management system server 114. At operation 740, target device 502 reconfigures beacon 290 with the custom ID and transmits that new custom ID to EUD 264 of the player 406. In some embodiments, target device 502 (e.g., interface controller 250) may generate the new custom ID. In such embodiments, target device 502 may also transmit the custom ID to casino management system server 114 for later confirmation during subsequent steps in the connecting process described herein.

At operation 750, EUD 264 receives the new custom ID from beacon 290 and transmits a connecting request to casino management system server 114. The connecting request identifies the identity of player 406 (e.g., via loyalty ID, personal device ID, app ID, or such) as well as the new custom ID received from beacon 290. At operation 760, casino management system server 114 determines with which target device 502 the connecting request is associated (e.g., based on the received new custom ID) and may authenticate the identity of EUD 264 (e.g., based on comparing the device ID of the request with the stored personal device ID associated with the new custom ID). In some embodiments, casino management system server 114 may determine an identity of player 406 (e.g., based on a player account name, a loyalty account ID, a mobile device ID of the mobile device 604), and may provide player identification and other profile information on player 406 to target device 502. If request 1550 is authenticated, casino management system server 114 transmits a connecting authorization message to target device 502 authorizing connecting with EUD 264 at operation 762. The authorization message may also provide the identity of player 406 (e.g., loyalty ID, app ID, or such) and other player information of player 406 to target device 502. At operation 770, target device 502 establishes connection with EUD 264.

Once connection has been confirmed between EUD 264 and target device 502, target device 502 transmits a connecting confirmation message to casino management system server 114 at operation 772. In some embodiments, EUD 264 may additionally or alternatively transmit a connecting confirmation message to casino management system server 114. At operation 780, casino management system server 114 stores a record of the active connection (e.g., in a database). The connection record may include device information of EUD 264, player information of player 406, or device information of target device 502. In some embodiments, upon confirmation of the connection, casino management system server 114 may transmit an image of or otherwise associated with target device 502 to EUD 264, and EUD 264 (e.g., the player app 410) may display the image of target device 502 to provide additional confirmation to player 406 that connection has been successful and a visual indicator of target device 502 (e.g., for player assurance). In some embodiments, once the connection is established, the beacon may revert back to an idle ID (e.g., the custom beacon ID may only be available during the connection process).

Similar to process 600, no data is transmitted directly from EUD 264 to target device 502 (e.g., over connection 516). Additionally, and again similar to process 600, EUD 264 may perform monitoring activities over connection 516 while the connection remains established. When the connection is terminated (e.g., based on loss of signal, loss of power, loss of connection, or by user or device request), EUD 264 or target device 502 may transmit a disconnection message to the casino management system server 114, causing the connection record to be updated as disconnected or deleted from the database.

In some embodiments, target device 502 may not establish connecting EUD 264. For example, process 700 may omit operations 762, 770, and 772, and may allow the connected actions 680 once casino management system server 114 has verified that EUD 264 has properly identified the custom ID broadcast by target device 502. In such embodiments, mobile EUD 264 may perform tethering with target device 502. For example, the mobile EUD 264 may periodically detect whether the beacon ID of the target device 502 is still visible, within a predetermined range, or whether beacon 290 of the target device 502 is at a minimum signal strength. When the mobile EUD 264 detects conditions outside of this configuration, the mobile EUD 264 may transmit a connection termination message to the casino management system server 114, which in turn may update the database with the disconnection.

Figure 8:
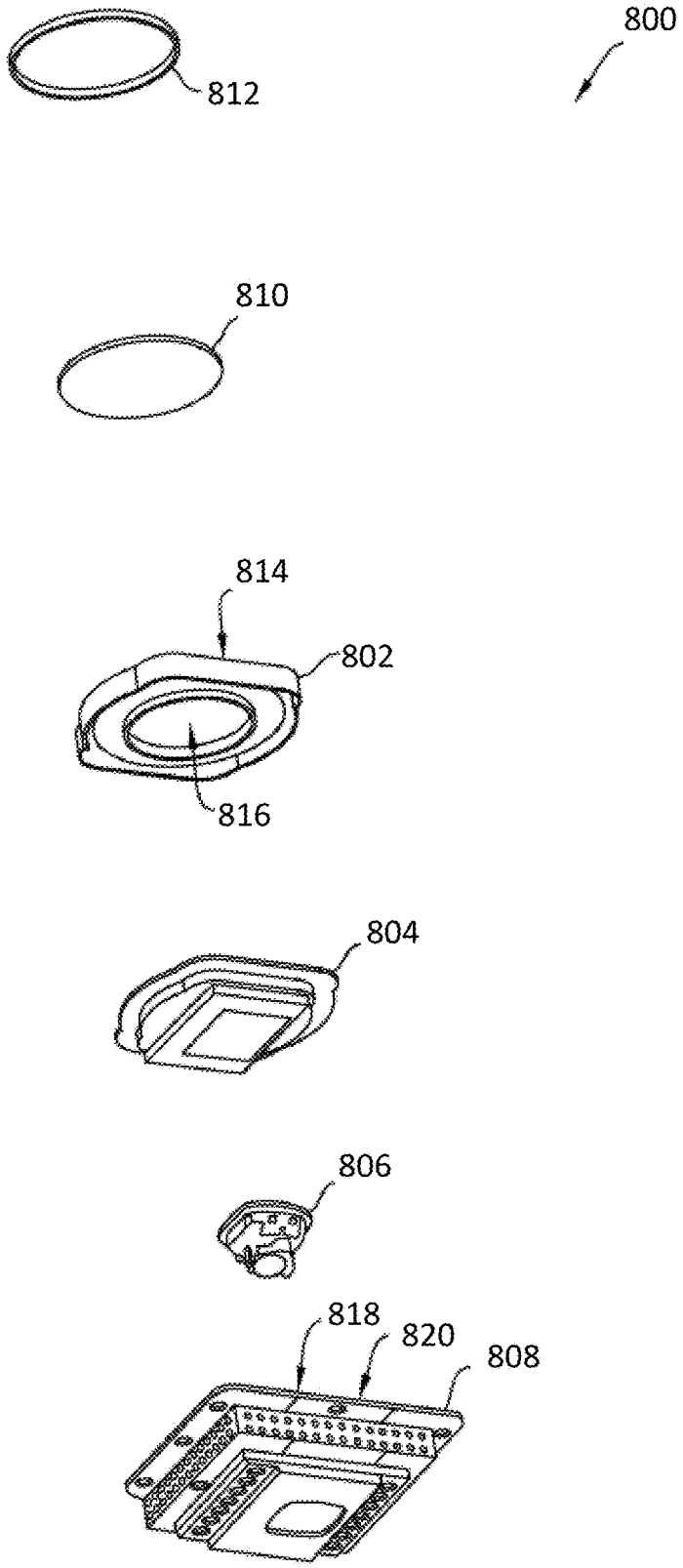
FIG. 8 is an expanded view of an example wireless charging apparatus.

FIG. 8 is an exploded view of a wireless charging apparatus 800 that may be coupled to any of target devices 502 such that while player 406 is placed upon a target device 502 as described above, player 406 may charge EUD 264 at target device 502. This is particularly important in the example embodiment because in order to not touch target device 502 while playing a game, EUD 264 needs to be powered on. In some embodiments, wireless charging apparatus 800 may include a pushbutton, an adapter plate 802, a wireless charging device 804, a switch assembly 806, and/or a housing 808. The pushbutton may further include a legend plate 810 for specifying a pushbutton function (e.g., a "Spin" or "Bet" function). Legend plate 810 may, in addition, be mounted under a lens cap 812, which may be transparent, and which may permit a player to view or read an inscription on legend plate 810. In the example embodiment, the pushbutton is displayed on EUD 264. In some embodiments, wireless charging apparatus 800 may be positioned below the surface of button deck 120. In some embodiments, wireless charging apparatus 800 may be position below a surface of virtual button deck 120 (e.g., beneath a surface of virtual button deck 120 touchscreen), thus not requiring a physical pushbutton, switch assembly, etc.

In the example embodiment, charging apparatus 800 with wireless charging device 804 thereon is configured to be coupled to any of target devices 502 such that player 406 can easily operate target device 502 via EUD 264 (e.g., via player app 410 EGM user interface component). For example, when charging apparatus 800 is coupled to EGM 104, charging apparatus 800 may be coupled to button deck 120 of EGM 104 so that player 406 has the same feel playing a game on EGM 104 via EUD 264 as player 406 would if they were playing the game while touching the physical or touchscreen pushbuttons on button deck 120 of EGM 104.

Switch assembly 806 may include any suitable pushbutton switch assembly, such as any switch assembly available for use with a mechanical pushbutton of an electronic gaming machine and commonly available in the gaming industry. In some embodiments, switch assembly 806 may include one or more light emitting diodes (LEDs) configured to illuminate a pushbutton.

In the exemplary embodiment, adapter plate 802 is a custom manufactured component that is configured to mount between the pushbutton and wireless charging device 804. To this end, adapter plate 802 may include a first receiving surface 814 configured to receive and/or engage the pushbutton and a second receiving surface 816 configured to receive and/or engage on wireless charging device 804. Thus, adapter plate 802 may be implemented between the pushbutton and wireless charging device 804 to securely mount the pushbutton and wireless charging device 804 within wireless charging apparatus 800.

Adapter plate 802 may be manufactured from any suitable material, such as plastic, and may be configured to move within housing 808 (e.g., in response to depression by a player of the pushbutton) to mechanically engage, with the pushbutton and wireless charging device 804, with switch assembly 806. Thus, a player may mechanically depress the pushbutton within adapter plate 802 to initiate a "Spin" or "Bet" feature of the pushbutton, as described above. Switch assembly 806 may, in response to selection by a player of the pushbutton, electrically and/or mechanically engage a control circuit (not shown) within cabinet 12 of gaming machine 10 to transmit a signal to game controller 60 indicating that the player has selected or depressed the pushbutton.

Wireless charging device 804 may include any suitable device for inductively charging a mobile communications device, as described above. Specifically, wireless charging device may include a coil, which may be energized during operation, such that wireless charging device 804 generates an electromagnetic field suitable to inductively charge a mobile communications device. To this end, wireless charging device 804 may be electrically and/or mechanically coupled to a power source, such as a power inverter, which may drive wireless charging device 804 during operation. In some embodiments, wireless charging device 804 is a wireless charging transmitter, such as a wireless charging transmitter model DMTX-19V15W-EZ-SYS, available from the SEMTECH Corporation.

In some embodiments, housing 808 is a custom manufactured component that is configured to receive and support the pushbutton, adapter plate 802, wireless charging device 804, and switch assembly 806. To this end, housing 808 may include an interior surface 818 that defines a recess 820 for receiving and supporting the pushbutton, adapter plate 802, wireless charging device 804, and switch assembly 806. Like adapter plate 802, housing 808 may be manufactured from any suitable material, such as, for example, plastic.

In operation, wireless charging apparatus 800 may be mounted under or within a button deck, such as at any location of the pushbutton. Specifically, wireless charging apparatus 800 may be mounted under or within a button deck (e.g., button deck 120), such that wireless charging device 804 is seated a small distance under the button deck, such as between 6 millimeters and 10 millimeters under the button deck and/or such that, during operation, a mobile communications device disposed in proximity to wireless charging apparatus is approximately 6-10 millimeters from wireless charging apparatus 800. Thus, any pushbutton location may be configured to include wireless charging apparatus 800.

More particularly, housing 808 may be inserted within a mounting aperture (not shown) formed in the button deck. In other embodiments, wireless charging apparatus 800 may be mounted within the button deck at any other suitable location, such as any location that would not otherwise include a pushbutton (e.g., a physical or touchscreen pushbutton). In such an embodiment, wireless charging apparatus 800 may exclude a pushbutton, and may be mounted under a play surface of the button deck. The button deck may include, in either case, an indicator, such as a shaped indicator (e.g., a rectangular indicator, a circular indicator, and the like) that indicates a location over which a mobile communications device should be placed to receive a charge. In some embodiments an indicator may be provided using a video graphic image shown on a display of virtual button deck 120. In other embodiments, one or more indicia, such as the words "Charge Available" and/or "Charge and Spin Available" may be inscribed or displayed in proximity to wireless charging apparatus 800 to indicate a location over which a mobile communications device should be placed to receive a charge.

To charge a mobile communications device during gameplay, a player may place the mobile communications device in proximity to wireless charging apparatus 800, such as, for example, over the pushbutton. In response to placement of a mobile communications device in proximity to wireless charging apparatus 800, wireless charging device 804 may generate an electromagnetic field (e.g., on detection of mobile communications device) that inductively charges the mobile communications device.

In some embodiments, a device (e.g., device 502) with apparatus 800 thereon may detect when a phone is being charged by device 804. For example, device 502 may detect when a device is being charged by device 804, and request, transmit, and broadcast a new custom ID (e.g., see 720, 722, and 730 in FIG. 7) in response thereto.

Figure 9:
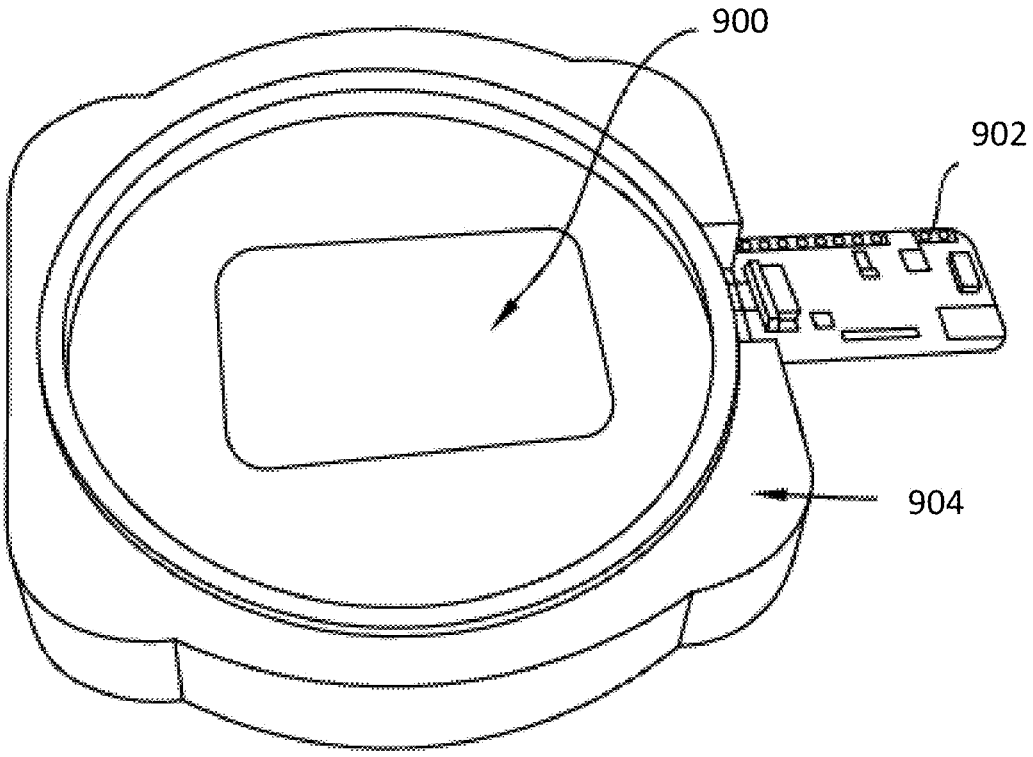
FIG. 9 is a top view of an example wireless communications device for use with the wireless charging apparatus shown in FIG. 8.

FIG. 9 is a top view of an exemplary wireless device 900, such as any near field communications (NFC) device, any BLUETOOTH wireless device, any WiFi wireless device, and the like, for use with wireless charging apparatus 800

(shown in FIG. 7). In some embodiments, wireless device 900 may be implemented with wireless charging apparatus 800, such that a mobile communications device may be substituted for the pushbutton. Specifically, wireless device 900 may be networked between a game controller (e.g., game controller 202) of a gaming machine (e.g., EGM 104) and a controller of the mobile communications device, such that the mobile communications device displays a surrogate or replacement pushbutton (not shown) for selection by the player. Thus, wireless charging apparatus 800 may be configured such that a mobile communications device may be placed over a pushbutton (obscuring the pushbutton from operation by the player) without impacting the functionality of a button deck (e.g., because the pushbutton is displayed on EUD 264).

To configure wireless charging apparatus 800 with wireless device 900, wireless device 900 may be mounted within wireless charging apparatus 800, such as, for example, between adapter plate 802 and wireless charging device 804 and/or between adapter plate 802 and a pushbutton. However, in other embodiments, wireless device 900 may be mounted within wireless charging apparatus 800 and/or elsewhere within or beneath a button deck in any suitable location. In addition, and in various embodiments, wireless device 900 may include any suitable NFC communications device, such as, for example, an NFC device make and model number AS 3955 available for purchase from the AMS Corporation.

In the exemplary embodiment, wireless device 900 may also include a wireless controller 902, such as an NFC controller, which, as described above, may be networked between a game controller (e.g., game controller 202) of a gaming machine (e.g., EGM 104) and a controller of the mobile communications device. Like wireless device 900, controller 902 may include any suitable wireless device controller, such as an NFC controller available for purchase from the AMS Corporation for use with wireless device 900. To network wireless device 900 between a game controller (e.g., game controller 202) of a gaming machine (e.g., EGM 104) and a controller of the mobile communications device, controller 902 may be communicatively coupled (e.g., hardwired or wirelessly coupled) to the game controller. Similarly, controller 902 may be wirelessly and communicatively coupled, such as via wireless device 900, to a controller of mobile communications device, which may be configured to receive and transmit a wireless signal, such as a near field communications signal, a BLUETOOTH signal, a Wi-Fi signal, and the like.

In this embodiment, controller 902 may communicate with the game controller to provide one or more instructions, some as one or more computer-readable instructions, to the controller of the mobile communications device. Specifically, the instructions may enable the mobile communications device to display a replacement pushbutton on a display thereof, and the mobile communications device may execute the computer-readable instructions to display the replacement pushbutton. On selection of the replacement pushbutton, the controller of the mobile communications device may communicate, via wireless device 900, with the game controller to indicate to the game controller that a player has selected the replacement pushbutton. Thus, wireless device 900 and controller 902 may enable gameplay, even as a mobile communications device is wirelessly charged by wireless charging apparatus 800 and may obscure a pushbutton disposed under or below the mobile communications device.

Example Button Relay Device Embodiment

Figure 10:
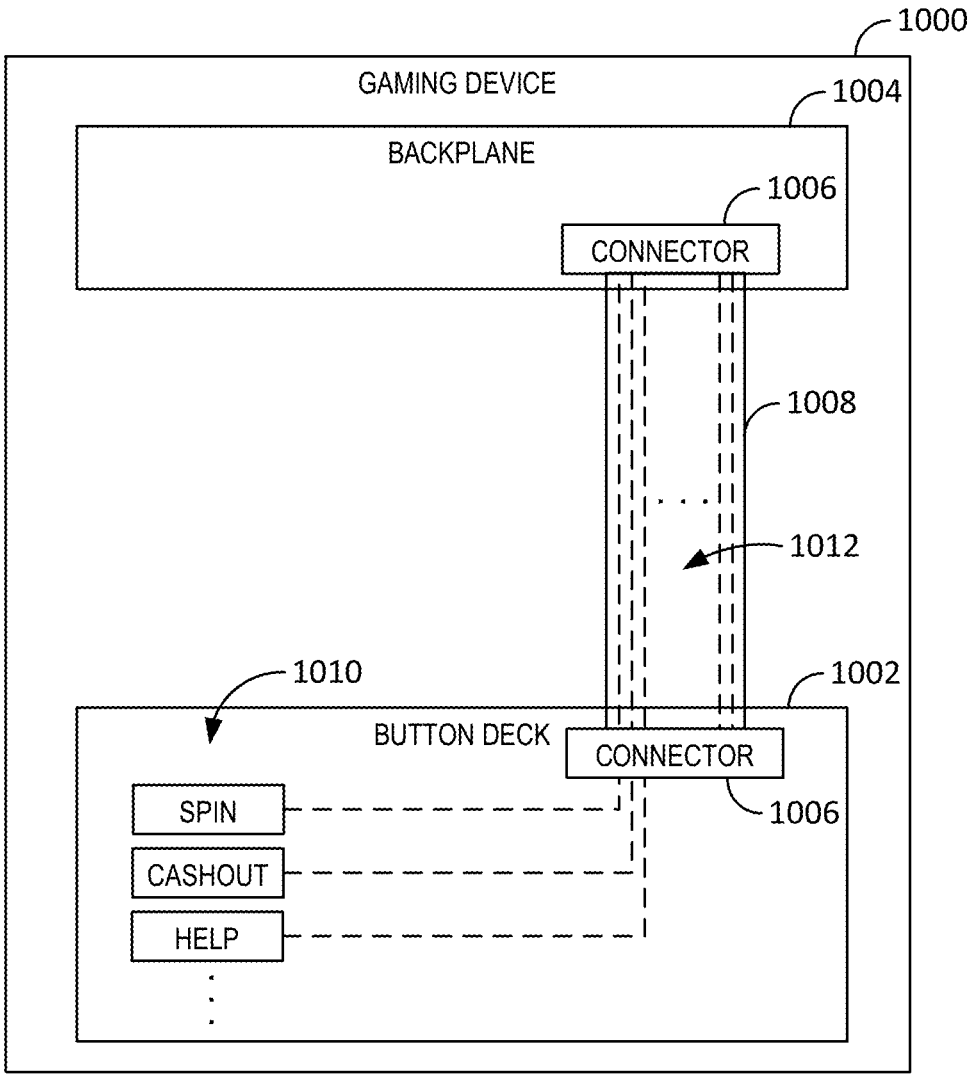
(Prior Art) FIG. 10
FIG. 10 is a diagram of a conventional gaming device known in the prior art.

FIG. 10 is a diagram of a conventional gaming device 1000 known in the prior art. The gaming device 1000 may be similar to EGMs 104 and gaming device 200 and it should be understood that numerous hardware components are excluded here for ease of explanation. In this example, the gaming device 1000 includes a button deck 1002 that includes multiple mechanical buttons 1010 used to play a wagering game (e.g., a slot style game), such as a spin button, a cash out button, and a service or "help" button, and may include additional buttons not depicted here (e.g., bet up, bet down, and so forth). The buttons 1010 of the button deck 1002 are connected to a backplane 1004 of the gaming device 1000 through a wiring harness (or "cable harness") 1008. The wiring harness 1008 includes multiple independent button signal wires (or just "wires") 1012 that are configured to provide button signals to the backplane whenever each particular button 1010 is pressed. The wire harness 1008 is plugged into connectors 1006 on both the button deck 1002 and the backplane 1004. In other embodiments, button signals may be provided from the button deck 1002 to the backplane 1004 using a serial communication interface (e.g., RS-232, USB, or the like). During operation, the gaming device 1000 may be configured to perform various game functions or gaming session functions based on player inputs provided through the buttons 1010, such as altering wagering amounts, initiating game play (e.g., spinning reels), cashing out of a current game session, requesting service or assistance, and the like. Various game and system processes executing on the gaming device 1000 may rely upon the signals from the buttons to determine when to perform related functions.

Figure 11:
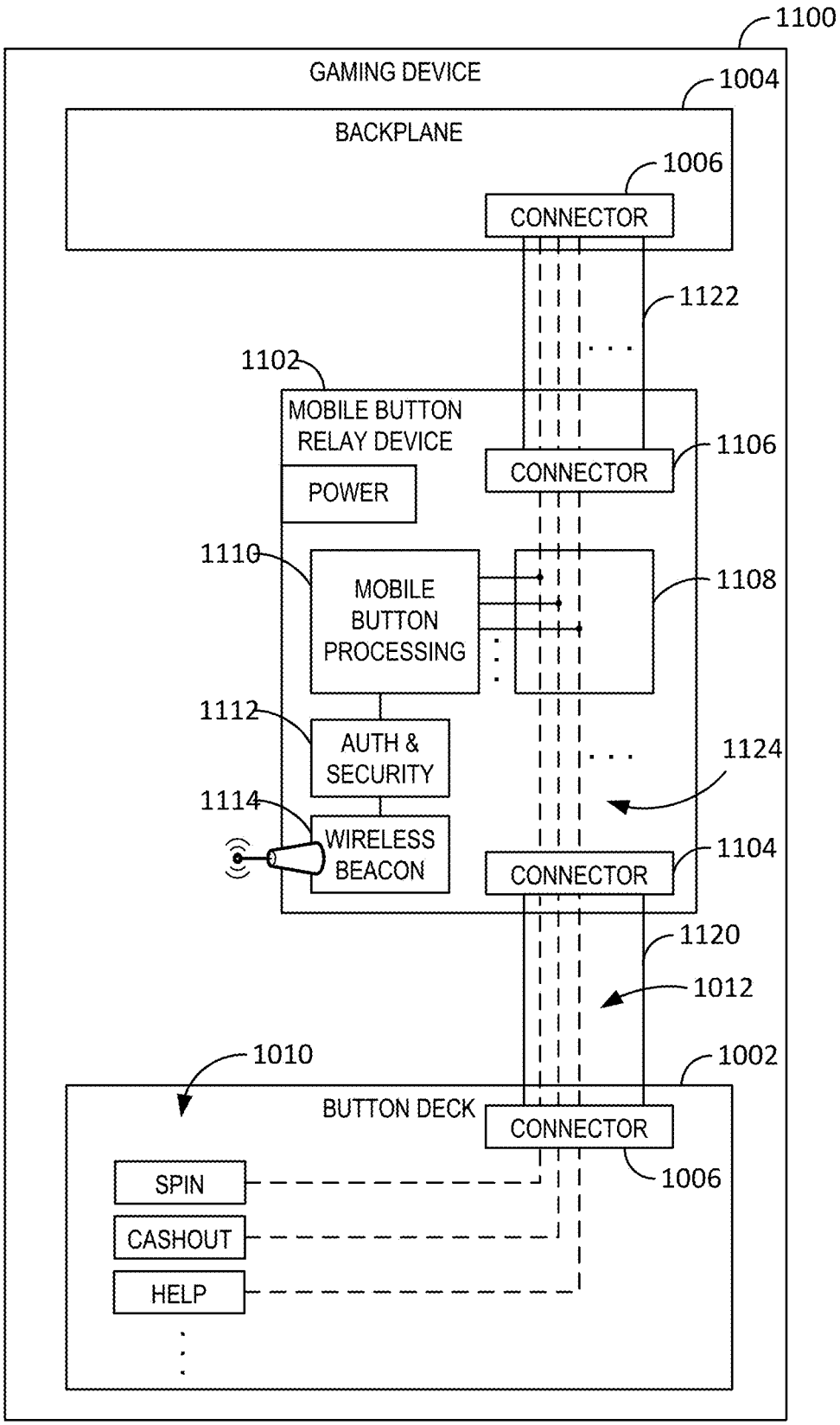
FIG. 11 is a diagram of a gaming device with an exemplary mobile button relay device that can be installed on conventional gaming devices such as the gaming device shown in FIG. 10.

FIG. 11 is a diagram of a gaming device 1100 with an exemplary mobile button relay device 1102 that can be installed on conventional gaming devices such as the gaming device 1000 shown in FIG. 10. The gaming device 1100 may be similar to the EGMs 104 shown in FIG. 1 or the gaming device 200 shown in FIG. 2A. In the example embodiment, the mobile button relay device 1102 is installed into the gaming device 1100 between the button deck 1002 and the backplane 1004 of the gaming device 1100. The mobile button relay device 1102 is configured to wirelessly connect with a mobile device (not shown in FIG. 4) of a nearby player and allow that player to perform player inputs (e.g., button presses) through their mobile device, thereby reducing player touches with the button deck 1002 and reducing risk of germ transmission.

In the example embodiment, the mobile button relay device 1102 includes a button deck wire harness 1120 that connects the button deck 1002 to a button deck connector 1104 on the relay device 1102. The relay device 1102 also includes a backplane wire harness 1122 that connects the backplane 1004 to a backplane connector 1106 on the relay device 1102. The wire harnesses 1120, 1122 may be similar to the wire harness 1008 shown in FIG. 10. In one example embodiment, the wire harnesses 1120, 1122 include up to 38 wires terminated with 38-pin dual-row plugs (e.g., MicroClasp receptacles) and the connectors 1006, 1104, 1106 are 38-pin dual-row headers (e.g., MicroClasp connectors). The relay device 1102 includes button signal paths 1124 that allow signals (e.g., caused by button presses on the button deck 1002) from each wire 1012 of the button deck harness 1120 to pass from the button deck connector 1104 to the backplane connector 1106 and out to the backplane harness 1122 and on to the backplane 1004. In some embodiments, the mobile button relay device 1102 may provide button signals to the backplane 1004 via an RS-232 serial interface or, in another example, the mobile button relay device 1102 may be a USB device, providing button signals to the backplane 1004 via a USB interface. As such, the relay device 1102 allows button signals to pass through, thereby allowing continued use of the mechanical buttons 1010 on the button deck 1002.

In the example embodiment, in addition to use of the mechanical buttons 1010 on the button deck 1002, the mobile button relay device 1102 also enables a mobile button deck feature for players. To facilitate the mobile button deck feature, the relay device 1102 includes a wireless beacon 1114 (e.g., a Bluetooth® beacon, NFC beacon, ultrasonic beacon, or the like) that is configured to wirelessly communicate with a mobile device (not shown in FIG. 11) of a nearby player (e.g., via Bluetooth® connecting and communication). The mobile button relay device 1102 includes an authentication and security module 1112 that authenticates players and their mobile devices before the mobile button deck feature is enabled. The relay device 1102 also includes a mobile button processing module 1110 that, once connected with and successfully authenticating the mobile device of the player, is configured to receive mobile button press events from the mobile device and introduce button signals onto any of the appropriate button signal paths 1124. For example, a spin mobile button press event may be received from the mobile device and the mobile button processing module 1110 may introduce a button press signal on the button signal path 1124 associated with the spin button. Each of the button signal paths 1124 are connected through a Y-junction module 1108 that allows the mobile button processing module 1110 to introduce signals onto the individual button signal paths 1124, thereby allowing both the button signals originating from the button deck 1002 to effectuate their associated button functions, but also allowing mobile button presses from the mobile device of the player to effectuate the same associated button functions. Further, the mobile button relay device 1102 can be inserted into the normal path between the button deck 1002 and backplane 1004, thereby allowing a seamless integration into existing gaming devices (e.g., without need to reconfigure the outputs of the button deck 1002, the hardware of the backplane 1004, or the software operations of the native games, platforms, or operating systems of the gaming device).

Figure 12:
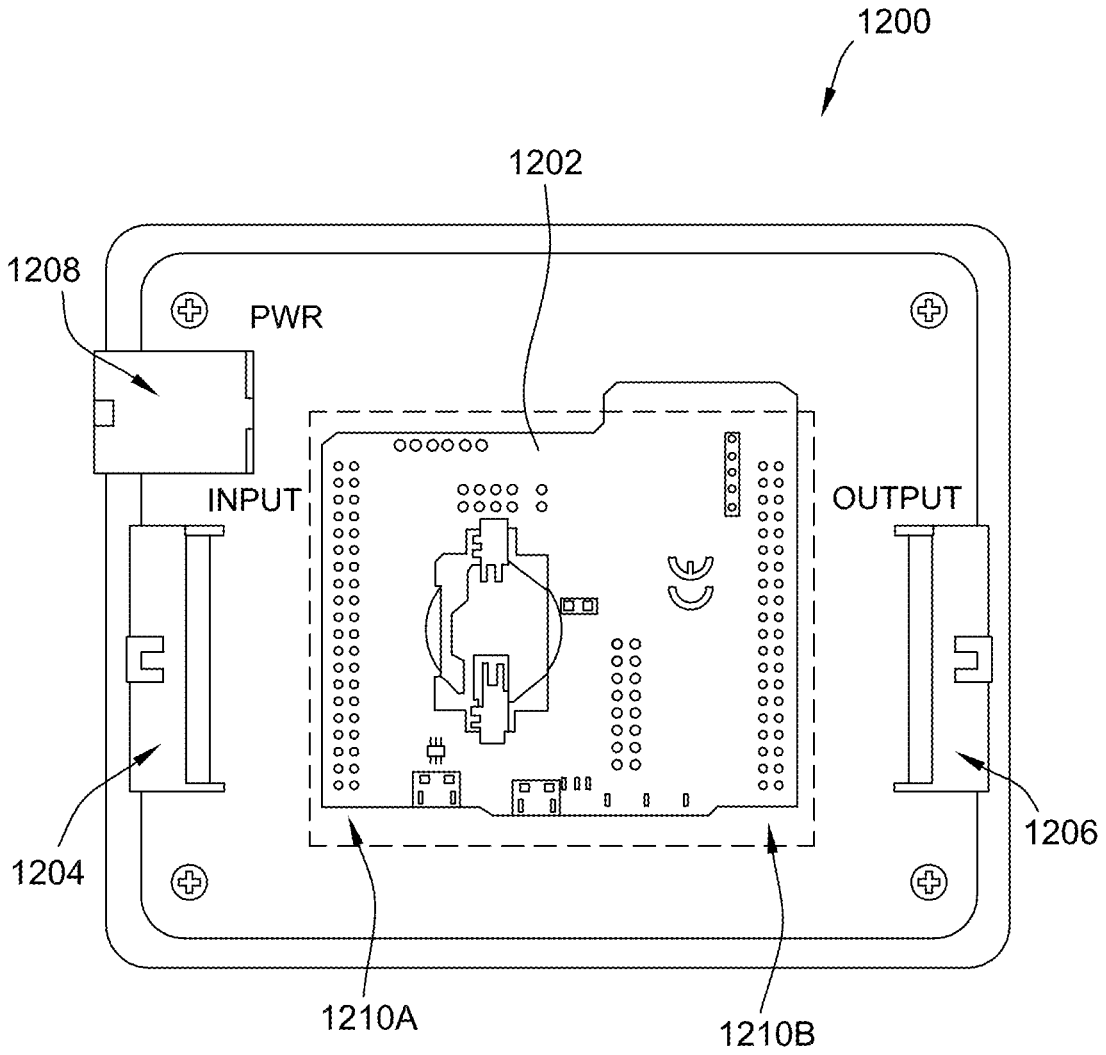
FIG. 12 is an image of an example mobile button relay device that may be similar to the mobile button relay device shown in FIG. 11.

FIG. 12 is an image of an example mobile button relay device 1200 that may be similar to the mobile button relay device 1102 shown in FIG. 11. In the example embodiment, the relay device 1200 includes an input connector 1204 that is configured to connect to a button deck of a gaming device, such as the button deck 1002, and that may be similar to the button deck connector 1104 shown in FIG. 11. The relay device 1200 also includes an output connector 1206 that is configured to connect to a backplane of a gaming device, such as the backplane 1004 of gaming device 1100 shown in FIG. 11, and that may be similar to the backplane connector 1106. The relay device 1200 includes a main circuit board 1202 that is powered via a power connector 1208 (e.g., receiving +5 volt (V) and ground from a power source, not shown), and that, amongst other functionality described herein, is configured to allow input signals on any or all of 38 input lines of the input connector 1204 (e.g., from each wire 1012) to pass straight through to any or all of 38 output lines of the output connector 1206.

The main circuit board 1202, in the example embodiment, also includes two 40-pin (e.g., 2×20) headers 1210 that are configured to receive a communications board (not shown). The communications board includes a Bluetooth® wireless beacon that is configured to transmit and/or receive data with nearby Bluetooth-enabled devices (e.g., mobile devices of players, support devices, or the like) and may be similar to the wireless beacon 1114 shown in FIG. 11. In this example embodiment, the communications board manages connectivity and communication with nearby devices and passes data to and from the main circuit board 1202 for processing. For example, during operation, button press signals from a mobile device of a player are received by the communications board and passed to the main circuit board 1202, and the main circuit board 1202 introduces button press signals on the appropriate output line (e.g., based on which button was pressed on the mobile device).

Figure 13:
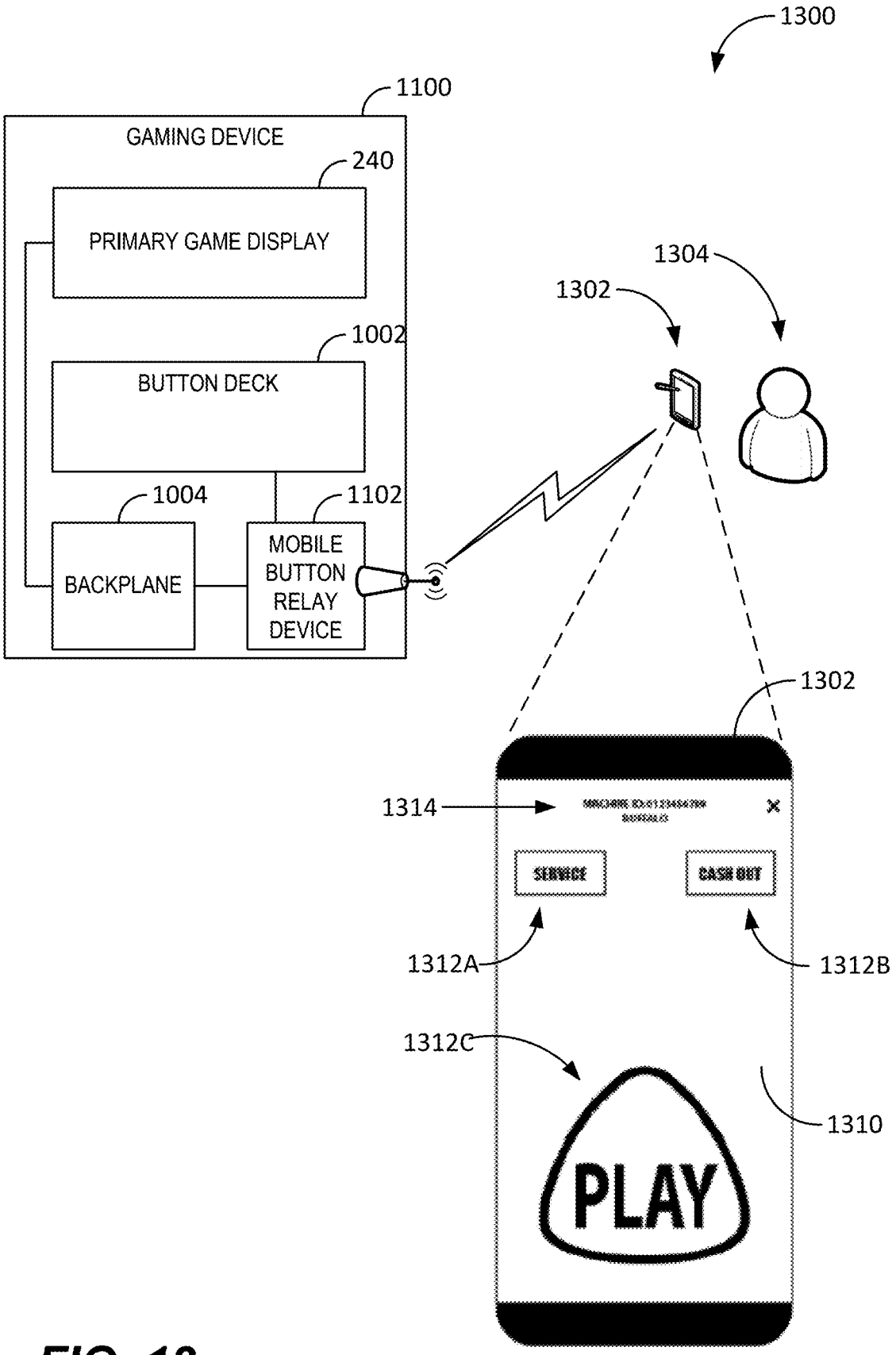
FIG. 13 is a diagram of an example virtual button deck system that allows a player to interact wirelessly with the gaming device via the mobile button relay device.

FIG. 13 is a diagram of an example virtual button deck system 1300 that allows a player 1304 to interact wirelessly with the gaming device 1100 via the mobile button relay device 1102. In the example embodiment, the mobile button relay device 1102 is installed between the button deck 1002 and the backplane 1004, thereby allowing mechanical or virtual buttons of the button deck 1002 to be passed through to the backplane 1004, but also allowing mobile button presses to be introduced on the same wires 1012. The relay device 1102 wirelessly connects to a mobile device 1302 of a player 1304, such as a smart phone, tablet, or other handheld or wearable (e.g., smart watch) computing device enabled to wirelessly communicate with the relay device 1102. In this example, the player 1304 installs a virtual button deck app on the mobile device 1302. The virtual button deck app includes a virtual button deck user interface ("UP") 1310 that is configured to display one or more virtual buttons 1312 and receive player inputs (e.g., via a touch-screen input device on a surface of the mobile device 1302). The example virtual button deck UI 1310 displays a service button 1312A, a cash out button 1312B, and a play button 1312C, but other button configurations are possible. The UI 1310 also displays connectivity information 1314 that includes a unique machine identifier ("UID") of the gaming device 1100 as well as a game title name (e.g., "Buffalo") of the current game presented on the gaming device 1100. Each button 1312 on the virtual button deck UI 1310 corresponds to a mechanical or virtual button 1010 provided by the button deck 1002 of the gaming device 1100, and may include virtual buttons 1312 for any of the buttons 1010 provided by the gaming device 1100. In some embodiments, the UI 1310 may toggle between a portrait presentation (e.g., as shown in FIG. 6) and a horizontal presentation (not shown) based on how the player 1304 has the mobile device 1302 oriented (e.g., vertical or horizontal).

During operation, the mobile device 1302 wirelessly connects to (e.g., Bluetooth-connects with) the mobile button relay device 1102 and prepares to send button press events. In some embodiments, the virtual button deck app may be configured to dynamically determine a set of virtual buttons 1312 to display on the virtual button deck UI 1310 based on, for example, a game identifier of the game currently running on the gaming device 1100, a pre-determined button set configured for the gaming device 1100 and determined based on the UID of the gaming device 1100. In some embodiments, the virtual button deck app may be configured display a default set of virtual buttons 1312 that are configured to work across multiple game types (e.g., a base set of service 1312A, cash out 1312B, and play 1312C (e.g., spin)). In some embodiments, the virtual button deck app may be configured to display a scrollable set of virtual buttons wherein the player may scroll through and select one or more virtual buttons 1312.

In the example embodiment, whenever the player 1304 presses one of the virtual buttons 1312 on the virtual button deck UI 1310, the mobile device 1302 is configured to wirelessly transmit a button press event message to the mobile button relay device 1102. The button press event message provides an identifier indicating which virtual button 1312 was pressed. Upon receipt of the button press event message, the relay device 1102 is configured to map the pressed virtual button 1312 to one of the output lines (e.g., based on a button mapping between the virtual buttons 1312 and the buttons 1010 of the button deck) and to generate a signal on that determined output line that emulates a native button press. As such, the backplane 1004 of the gaming device 1100 receives a button press signal that activates the natural underlying actions of that particular button within the game or game platform running on the gaming machine 1100.

In some embodiments, the gaming device 1100 may display a scannable image (e.g., bar code, QR code, or the like, on the primary display 240 or on a digital display-enabled button deck) that can be scanned by the mobile device 1302 during initial connectivity, thereby allowing the mobile device 1302 to authenticate with the mobile button relay device 1102, identify the UID or game ID of the gaming device 1100, or such. In some embodiments, a QR code may embed a UID associated with the mobile button relay device 1102. The scannable image may be digitally displayed on the gaming device 1100 (e.g., on one of the displays 240, 242 or on an digital display in the button deck 1002). In some embodiments, the scannable image may be printed and attached to an external surface of the gaming device 1100 (e.g., as a sticker with a QR code attached to the button deck 1002 or other accessible and visible surface of the gaming device 1100). In some embodiments, the gaming device 1100 may include an adjunct display device (not shown) that can be affixed to the gaming device 1100 and that communicates with the mobile button relay device 1102, thereby acquiring the scannable image from the mobile button relay device 1102. The mobile button relay device 1102 may be configured to periodically change the scannable image (e.g., for security reasons), and may thus use the adjunct display device to update the scannable image. In some embodiments, the adjunct display device is wired to the mobile button relay device 1102, where in other embodiments the adjunct display device is in wireless communication with the mobile button relay device 1102.

The wireless connection between a public device (e.g., the gaming device 1100) and a private device of the player 1304 (e.g., the mobile device 1302) allows the player 1304 to avoid physical contact with the gaming device 1100 by allowing the player 1304 to perform button interactions through their own private device rather than through contact with the surfaces of the public device. As such, the player 1304 can minimize risk of disease transmission and other health risks that may otherwise be more elevated through surface contact. The insertion of the relay device 1102 into the pre-existing button signal paths 1124 allows for the relay device 1102 to be installed into existing EGMs and maintaining the native operations of existing button decks while still allowing button signals to be introduced and emulated on those existing signal paths.

The wireless session between the mobile device 1302 and the gaming device 1100 is configured to terminate upon the occurrence of any one of multiple events. In some embodiments, the relay device 1102 is configured to terminate the virtual button session with the mobile device 1302 when the relay device 1102 loses wireless connectivity with the mobile device 1302 or when the mobile device 1302 moves outside of a predefined distance of the gaming machine 1100. In some embodiments, the relay device 1102 is configured to terminate the virtual button session with the mobile device 1302 after a predefined inactivity period (e.g., after 60 seconds of no button presses) or the mobile device 1302 may be configured to terminate the virtual button session after a predefined inactivity period (e.g., after 60 seconds of inactivity between the player 1304 and the virtual button deck app). In some embodiments, the relay device 1102 is configured to terminate the virtual button session after the player 1304 initiates a cash out of their current play session (e.g., via pressing a cash out button 1010 on the button deck 1002, detected via signal sensing on the associated wire 1012, or via pressing the virtual cash out button 1312B on the mobile device 1302, detected via a cash out button event message from the mobile device 1102).

Figure 14:
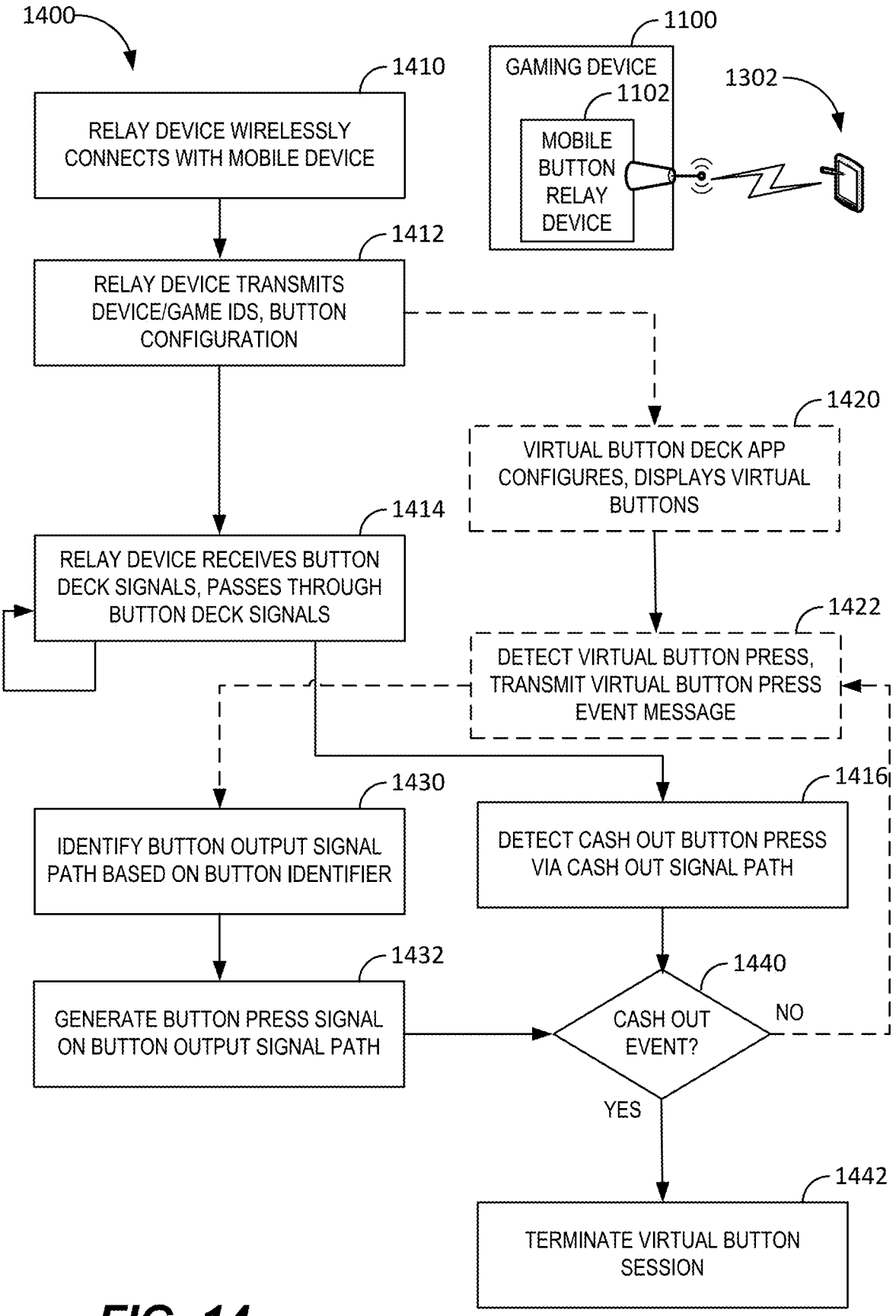
FIG. 14 is an example method of providing a virtual button interface for an EGM such as the gaming device.

FIG. 14 is an example method 1400 of providing a virtual button interface for an EGM such as the gaming device 1100. Broken lined boxes are used in FIG. 14 to illustrate operations performed by the mobile device 1302, where solid lined boxes are used to illustrate operations performed by the mobile button relay device 1102. In the example embodiment, the method 1400 is practiced using the mobile button relay device 1102 in wireless communication with the mobile device 1302 of the player 1304. At operation 1410, the relay device 1102 wirelessly connects with the mobile device 1302 (e.g., via Bluetooth® connection). The method 1400 may include authenticating the mobile device 1302 or the player 1304. At operation 1412, the relay device 1102 transmits a button configuration message to the mobile device 1302, which may include the UID of the gaming device 1100, the UID of the relay device 1102, and/or a game ID of the electronic game running on the gaming device 1100.

At operation 1414, the relay device receives button deck signals from buttons 1010 of the button deck 1002 and passes those signals through to the backplane 1004, thereby allowing continued use of the button deck 1002. If the player 1304 presses the cash out button 1010 on the button deck 1002, then at operation 1416, the relay device 1102 detects the cash out button press via the cash out wire 1012 and, after test 1440, terminates the virtual button session at operation 1442. Termination of the virtual button session includes closing the wireless connection between the relay device 1102 and the mobile device 1302 and returning to operation 1410 to await another connection attempt.

In the example embodiment, once the mobile device 1302 receives the button configuration message, the mobile device 1302 configures the virtual button deck app with virtual buttons for the electronic game at operation 1420 (e.g., buttons 1312). At operation 1422, the mobile device 1302 detects a virtual button press and transmits a virtual button press event message to the relay device 1102. The virtual button press event message identifies a button identifier that indicates which button was pressed. At operation 1430, the relay device 1102 receives the virtual button press event message and identifies which button output signal path is associated with that button based on the button identifier. At operation 1432, the relay device 1102 emulates a button press on that button output signal path by generating a button press signal on that button output signal path. If, at test 1440, the virtual button press signal event identifies a button press of the virtual cash out button 1312B, then the relay device 1102 terminates the virtual button session at operation 1442. Otherwise, the relay device 1102 returns to operation 1422 to await another virtual button press event message.

A computer, controller, or server, such as those described herein, includes at least one processor or processing unit and a system memory. The computer, controller, or server typically has at least some form of computer readable non-transitory media. As used herein, the terms "processor" and "computer" and related terms, e.g., "processing device", "computing device", and "controller" are not limited to just those integrated circuits referred to in the art as a computer, but broadly refers to a microcontroller, a microcomputer, a programmable logic controller (PLC), an application specific integrated circuit, and other programmable circuits "configured to" carry out programmable instructions, and these terms are used interchangeably herein. In the embodiments described herein, memory may include, but is not limited to, a computer-readable medium or computer storage media, volatile and nonvolatile media, removable and non-removable media implemented in any method or technology for storage of information such as computer readable instructions, data structures, program modules, or other data. Such memory includes a random access memory (RAM), computer storage media, communication media, and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

As indicated above, the process may be embodied in computer software. The computer software could be supplied in a number of ways, for example on a tangible, non-transitory, computer readable storage medium, such as on any nonvolatile memory device (e.g. an EEPROM). Further, different parts of the computer software can be executed by different devices, such as, for example, in a client-server relationship. Persons skilled in the art will appreciate that computer software provides a series of instructions executable by the processor.

While the disclosure has been described with respect to the figures, it will be appreciated that many modifications and changes may be made by those skilled in the art without departing from the spirit of the disclosure. Any variation and derivation from the above description and figures are included in the scope of the present disclosure as defined by the claims.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A casino computing device comprising at least one processor in communication with at least one memory, wherein the at least one processor is configured to:

receive, from a first electronic computing device associated with a player account of a player, a connection request that includes a wireless ID, wherein the wireless ID is associated with and broadcast by a second electronic computing device;

validate that the wireless ID matches a custom ID stored in the at least one memory;

based upon validating that the wireless ID matches the custom ID, store data regarding an association between the first electronic computing device and the second electronic computing device in the at least one memory; and receive instructions from the first electronic computing device, wherein the instructions are based upon the player interacting with the first electronic computing device to play a game operated on the second electronic computing device, wherein the instructions received from the first electronic computing device comprise a low-bandwidth instruction comprising no more than two bytes.

2. The casino computing device of claim 1, further configured to:

receive a request for an ID from the second electronic computing device; and in response to receiving the request, transmit the custom ID to the second electronic computing device.

3. The casino computing device of claim 2, further configured to transmit the custom ID such that, after receipt of the custom ID, the second electronic computing device broadcasts the custom ID to the first electronic computing device using low-bandwidth communication, wherein the low-bandwidth communication to the first electronic computing device comprises no more than two bytes, and wherein the custom ID includes no more than one byte corresponding to at least one button configuration, of a plurality of button configurations, to be displayed on the first electronic computing device.

4. The casino computing device of claim 3, further configured to configure the custom ID such that, upon receipt of the custom ID at the first electronic computing device, the at least one button configuration is caused to be displayed on the first electronic computing device.

5. The casino computing device of claim 2, further configured to configure the custom ID to be broadcast by a wireless communication device of the second electronic computing device.

6. The casino computing device of claim 1, further configured to:

receive a disconnection message from at least one of the first electronic computing device or the second electronic computing device; and in response to receipt of the disconnection message, update the data regarding the association between the first electronic computing device and the second electronic computing device to indicate that the first electronic computing device has disconnected from the second electronic computing device.

7. The casino computing device of claim 1, further comprising a relay device coupled to a wire harness of a button deck of the casino computing device by a connector including at least one button input path.

8. An electronic casino system comprising at least one processor in communication with at least one memory, wherein the at least one processor is configured to:

receive, from an electronic player device, a request comprising a wireless ID, wherein the wireless ID is specific to an electronic casino device in communication with the at least one processor;

confirm that the wireless ID matches a casino device identifier associated with the electronic casino device and stored in the at least one memory;

in response to confirming that the wireless ID matches the casino device identifier, transmit data regarding an affiliation between the electronic player device and the electronic casino device to the at least one memory for storage; and receive game data from the electronic player device, wherein the game data is associated with inputs received at the electronic player device to play a game operated on the electronic casino device, wherein the game data received from the electronic player device includes a low-bandwidth instruction with a length of two bytes or less.

9. The electronic casino system of claim 8, wherein the at least one processor is further configured to:

receive a request for a new ID from the electronic casino device; and in response to receiving the request:

generate the casino device identifier; and transmit the casino device identifier to the electronic casino device.

10. The electronic casino system of claim 9, wherein the at least one processor is further configured to generate and transmit the casino device identifier such that, based upon receipt of the casino device identifier, the electronic casino device transmits the casino device identifier to the electronic player device using low-bandwidth communication, wherein the low-bandwidth communication to the electronic player device comprises no more than two bytes, and wherein the casino device identifier includes no more than one byte corresponding to at least one button configuration, of a plurality of button configurations, for display on the electronic player device.

11. The electronic casino system of claim 10, wherein the at least one processor is further configured to generate and transmit the casino device identifier such that, upon receipt of the casino device identifier at the electronic player device from the electronic casino device, the at least one button configuration is controlled to be displayed on the electronic player device.

12. The electronic casino system of claim 9, wherein the at least one processor is further configured to generate and transmit the casino device identifier for broadcasting by a wireless communication device of the electronic casino device.

13. The electronic casino system of claim 8, wherein the at least one processor is further configured to:

receive a disconnect message from at least one of the electronic player device or the electronic casino device; and based upon receipt of the disconnect message, update the data regarding the affiliation between the electronic player device and the electronic casino device to indicate that the electronic player device has disconnected from the electronic casino device.

14. The electronic casino system of claim 8, wherein the at least one processor is further configured to receive instructions comprising the low-bandwidth instruction comprising no more than two bytes, wherein the no more than two bytes comprise at least one byte associated with a button press of a virtual button displayed at the electronic player device.

15. A non-transitory computer-readable storage medium with instructions stored thereon that, in response to execution by at least one processor, cause the at least one processor to:

receive, from an end user device (EUD) associated with a player, a connection request that includes a wireless ID as received by the EUD from an electronic casino device;

validate that the wireless ID matches a custom ID generated by the at least one processor;

store a valid association between the EUD of the player and the electronic casino device in a database; and receive instructions from the EUD, based on player interaction with the EUD, such that the player plays a game operated on the electronic casino device by physically interacting with the EUD, wherein the instructions received from the EUD include a low-bandwidth instruction comprising at least one byte associated with a button press of a button displayed at the EUD.

16. The non-transitory computer-readable storage medium of claim 15, wherein the instructions further cause the at least one processor to:

receive a request for an ID from the electronic casino device; and in response to receiving the request, transmit the wireless ID to the electronic casino device.

17. The non-transitory computer-readable storage medium of claim 16, wherein the instructions further cause the at least one processor to transmit the wireless ID such that, after receipt of the wireless ID, the electronic casino device broadcasts the wireless ID to the EUD using low-bandwidth communication, wherein the low-bandwidth communication to the EUD comprises no more than two bytes, and wherein the wireless ID includes no more than one byte corresponding to at least one button configuration, of a plurality of button configurations, to be displayed on the EUD.

18. The non-transitory computer-readable storage medium of claim 17, wherein the instructions further cause the at least one processor to configure the wireless ID such that, upon receipt of the wireless ID at the EUD, the at least one button configuration is caused to be displayed on the EUD.

19. The non-transitory computer-readable storage medium of claim 16, wherein the instructions further cause the at least one processor to configure the wireless ID to be broadcast by a wireless communication device of the electronic casino device.

20. The non-transitory computer-readable storage medium of claim 15, wherein the instructions further cause the at least one processor to:

determine the EUD has disconnected from the electronic casino device; and based upon determining that the EUD has disconnected from the electronic casino device, update the valid association to indicate that the EUD has disconnected from the electronic casino device.

* * * * *